US006003981A

United States Patent [19]

Cameron et al.

[11] Patent Number: 6,003,981

[45] Date of Patent: Dec. 21, 1999

[54] REPLACEABLE MODULE FOR A PRINTING COMPOSITION DELIVERY SYSTEM OF A PRINTING DEVICE

[75] Inventors: James Cameron, Portland, Oreg.; Robert L Battey, Vancouver, Wash.; Ngoc-Diep T Nguyen, St Camas, Wash.; Gary L. Miller, Vancouver, Wash.; Kenneth R. Williams, Vancouver, Wash.; John Sturman, Vancouver, Wash.

[73] Assignee: Hewlett-Packard Company, Palo Alto, Calif.

[21] Appl. No.: 08/866,862

[22] Filed: May 30, 1997

Related U.S. Application Data

[63] Continuation-in-part of application No. 08/706,060, Aug. 30, 1996.

[51] Int. Cl.[6] ..... B41J 2/175

[52] U.S. Cl. ..... 347/85

[58] Field of Search ..... 347/85–87, 49, 347/108

[56] References Cited

U.S. PATENT DOCUMENTS

| | | | |
|---|---|---|---|
| 3,102,770 | 9/1963 | McKeegan . | |
| 4,394,669 | 7/1983 | Ozawa et al. . | |
| 4,475,116 | 10/1984 | Sicking et al. | 347/86 |
| 4,528,576 | 6/1985 | Koumura et al. . | |
| 4,540,996 | 9/1985 | Saito . | |
| 4,672,432 | 6/1987 | Sakurada et al. | 358/75 |
| 4,684,962 | 8/1987 | Hirosawa et al. . | |
| 4,775,868 | 10/1988 | Sugiura . | |
| 4,806,956 | 2/1989 | Nishikawa et al. . | |

(List continued on next page.)

FOREIGN PATENT DOCUMENTS

| | | | |
|---|---|---|---|
| 419876 | 4/1991 | European Pat. Off. . | |
| 0 666 178 | 9/1995 | European Pat. Off. | B41J 2/175 |
| 0 699 533 | 6/1996 | European Pat. Off. | B41J 2/175 |
| 55-42858 | 3/1980 | Japan . | |
| 357210879 | 12/1982 | Japan . | |
| 58-208061 | of 1983 | Japan . | |
| 58-51156 | 3/1983 | Japan . | |
| 358194563 | 11/1983 | Japan . | |
| 60-232964 | of 1985 | Japan . | |

(List continued on next page.)

OTHER PUBLICATIONS

European Search Report mailed Oct. 20, 1998 regarding European Patent Application No. EP97306158.

*Primary Examiner*—N. Le
*Assistant Examiner*—Michael Nghiem
*Attorney, Agent, or Firm*—Erik A. Anderson

[57] ABSTRACT

A module for a printing composition delivery system of a printing device that is a separable unit from the printing composition delivery system is disclosed. An embodiment of the module includes a printing composition supply station connector, a printing member connector, and a flexible conduit. The printing composition supply station connector is releasably attached to a printing composition supply station of the printing composition delivery system and has a coupler fluidly connectable to a printing composition supply of the printing composition supply station. The printing member connector is releasably attached to the printing device and has a coupler fluidly connectable to the printing member. The flexible conduit includes a first end fluidly connected to the coupler of the printing composition supply station connector and a second end fluidly connected to the coupler of the printing member connector to supply printing composition from the printing composition supply to the printing member. The module may additionally include a housing covering a portion of the coupler of the printing member connector and enclosing a portion of the flexible conduit adjacent the printing member connector. The printing composition supply station connector, the printing member connector, the flexible conduit, and the housing, if present, are a separable unit from the printing composition delivery system. A method of installing and removing the module is also disclosed.

14 Claims, 20 Drawing Sheets

U.S. PATENT DOCUMENTS

| | | | |
|---|---|---|---|
| 4,831,389 | 5/1989 | Chan . | |
| 4,905,024 | 2/1990 | Nishikawa et al. . | |
| 4,926,196 | 5/1990 | Mizoguchi . | |
| 4,929,963 | 5/1990 | Balazar . | |
| 4,999,652 | 3/1991 | Chan | 347/86 |
| 5,025,270 | 6/1991 | Umezawa . | |
| 5,043,746 | 8/1991 | Abe . | |
| 5,469,201 | 11/1995 | Erickson et al. | 347/85 |
| 5,686,947 | 11/1997 | Murray et al. | 347/85 |

FOREIGN PATENT DOCUMENTS

| | | |
|---|---|---|
| 60-264255 | of 1985 | Japan . |
| 360264255 | 12/1985 | Japan . |
| 61-27259 | of 1986 | Japan . |
| 61-5950 | 1/1986 | Japan . |
| 62-116152 | of 1987 | Japan . |
| 62-218136 | of 1987 | Japan . |
| 36215288 | 7/1987 | Japan . |
| 62-161544 | 7/1987 | Japan . |
| 36222034 | 9/1987 | Japan . |
| 363147651 | 6/1988 | Japan . |
| 363154354 | 6/1988 | Japan . |

FIG. 12
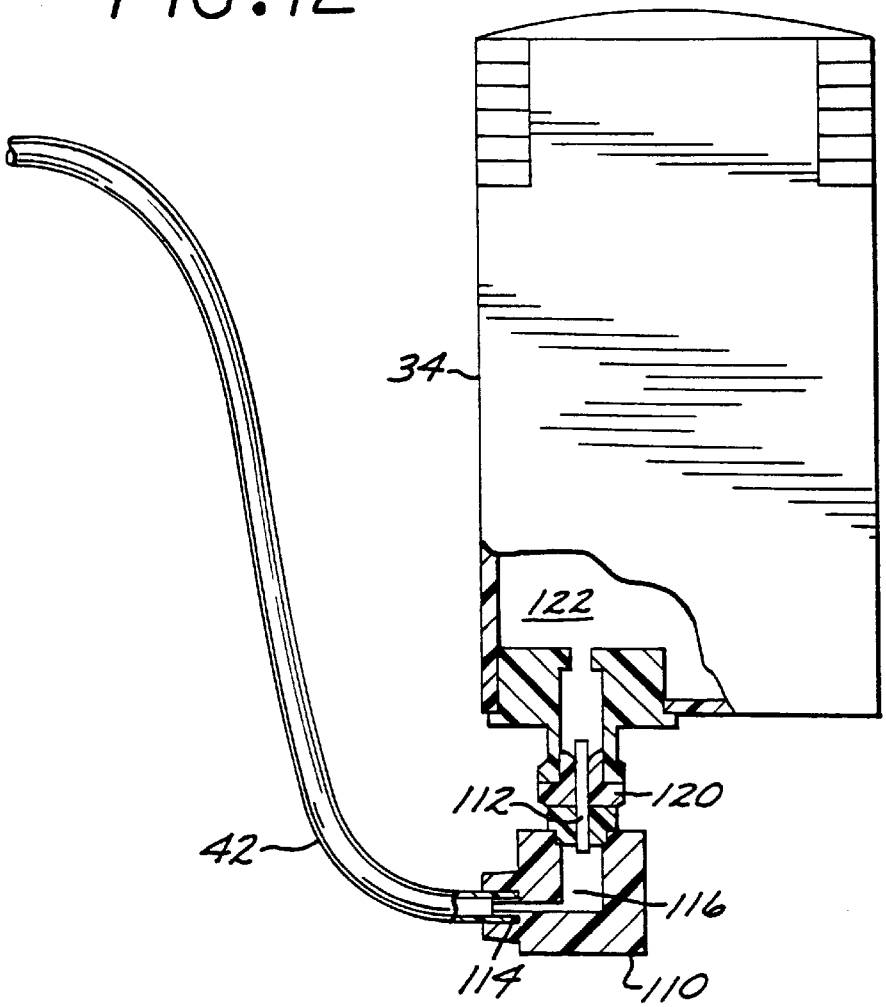
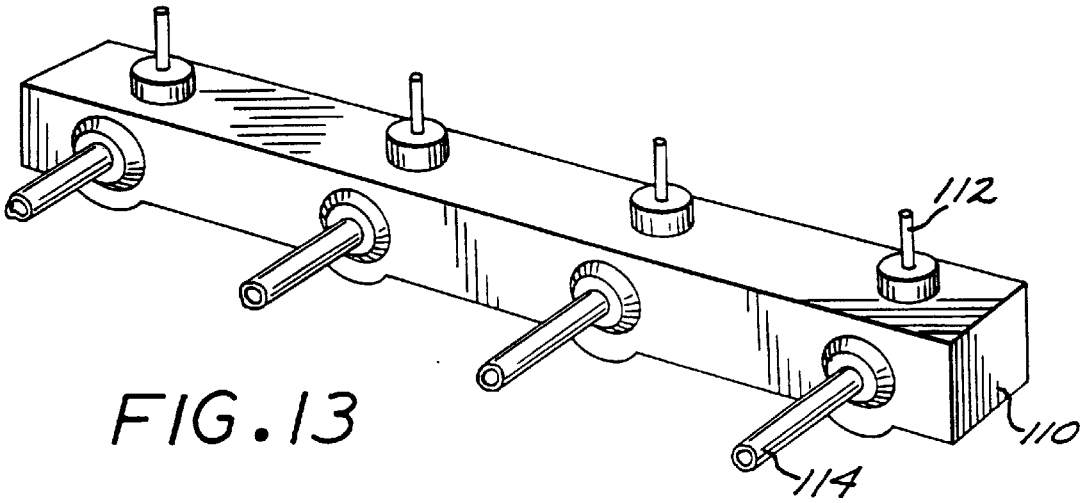
FIG. 13

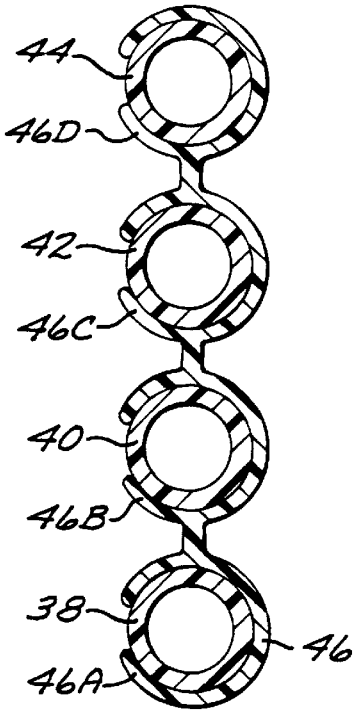
FIG.14
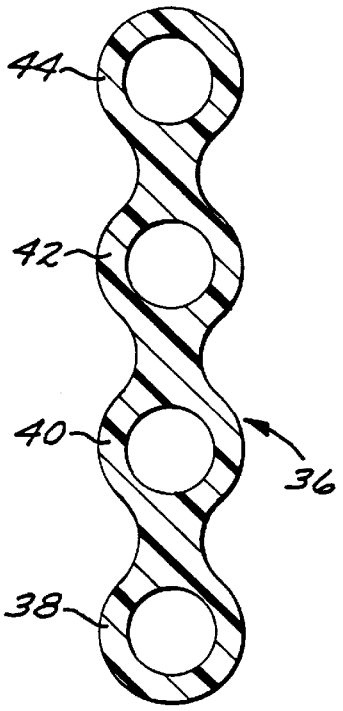
FIG.15
FIG.16
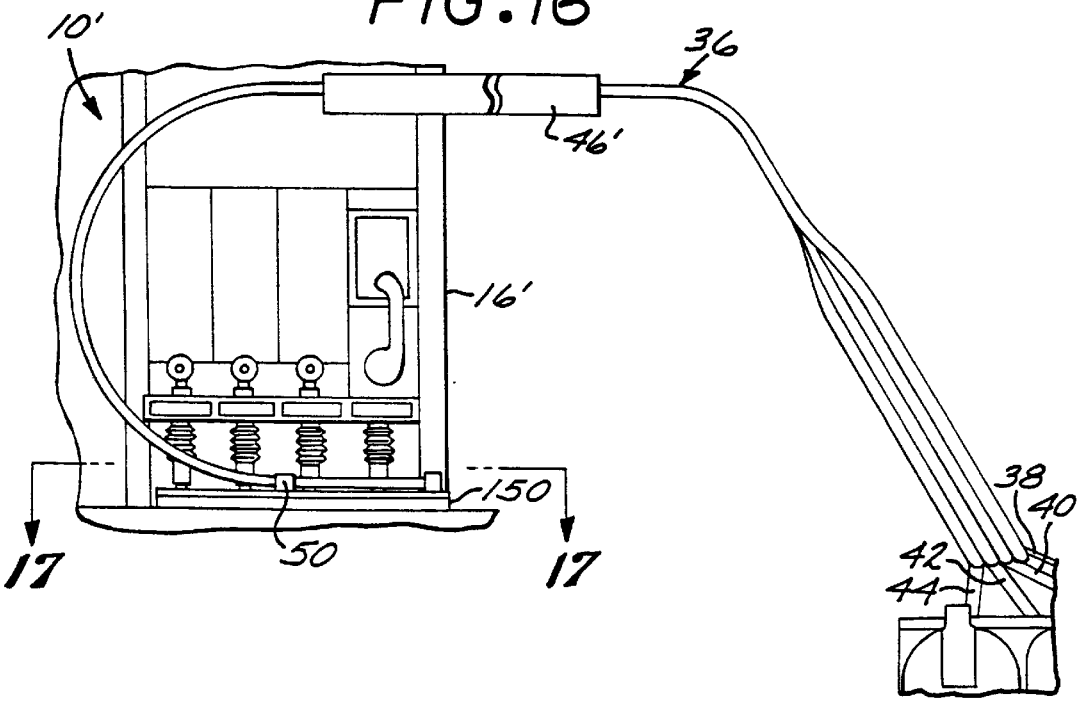

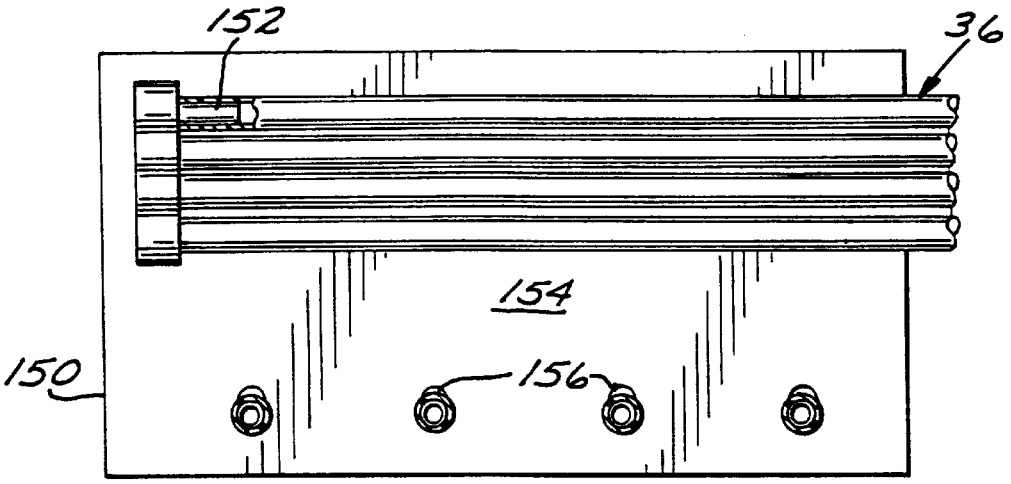
FIG. 17
FIG. 18
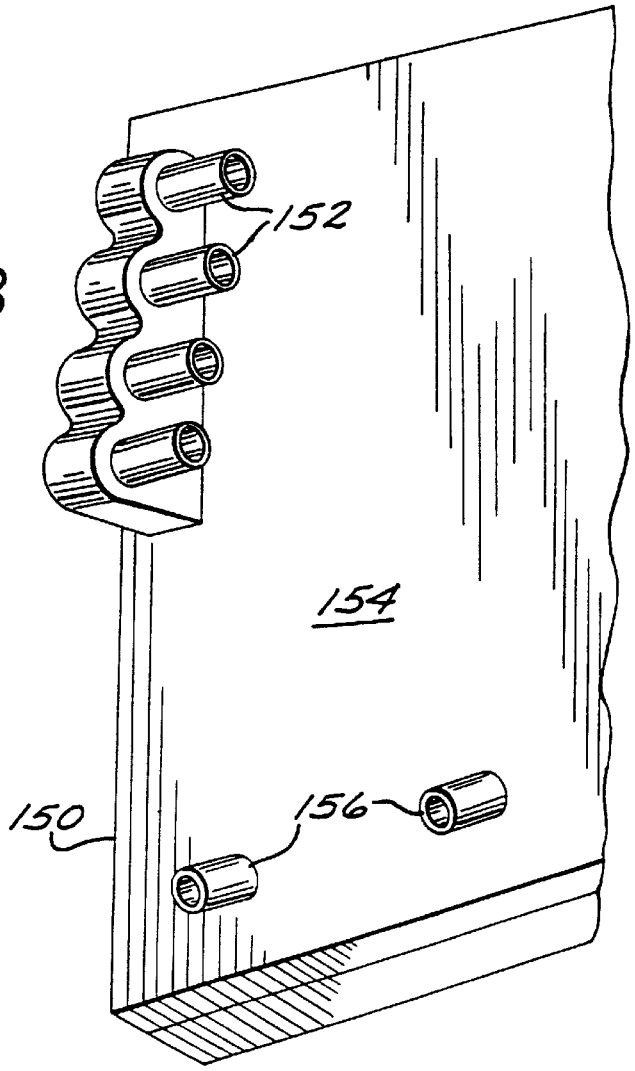

REPLACEABLE MODULE FOR A PRINTING COMPOSITION DELIVERY SYSTEM OF A PRINTING DEVICE

CROSS-REFERENCE TO RELATED APPLICATIONS

This is a continuation-in-part application of co-pending U.S. patent application Ser. No. 08/706,060, filed on Aug. 30, 1996.

TECHNICAL FIELD OF THE INVENTION

The present invention relates to printing devices, such as ink-jet printers. More particularly, the present invention relates to a module for a printing composition delivery system of a printing device that is a separable unit from the printing composition delivery system, and also relates to a method of installing and removing the module.

BACKGROUND OF THE INVENTION

Ink-jet printers are well known in the art, and many utilize a carriage which carries one or more ink-jet cartridges or pens in a traversing or scanning movement transverse to the printer paper path. It is also known to provide an external stationary ink reservoir connected to the scanning cartridge via a tube. The external reservoir is typically known as an "off-axis" ink reservoir. While providing increased ink capacity, these off-axis systems present a number of problems, however. The space requirements for the off-axis reservoirs and tubing impact the size of the printer, with consequent cost increase. Moreover, pressure drops through the tubing can reduce printer throughput and affect printing quality. Another problem is that of vapor losses from the tubing and air diffusion into the tubing system. In the past, tubing such as LDPE (low density polyethylene) has been used, since it is a low modulus material which is easy to bend. This low modulus material suffers from relatively high vapor losses and air diffusion into the tube. As a result of the vapor losses, the ink can change properties, degrading print quality and eventually causing tube or printhead clogging. As a result of air ingestion, the printhead can fill with air. During thermal fluctuations, the air can expand, causing printhead drool. In addition, the air can cause printhead starvation. Further problems include the force exerted on the carriage by the tubing, and the stresses on the tubing that tends to cause buckling or fatigue failures. These problems are exacerbated with a low end off-axis printing system with its relatively small form factor.

It would therefore be an advantage to provide a compact, low end off-axis printing system.

It would further be advantageous to provide such a printing system which permits high throughput printing, with relatively high flow rates through the tubing.

Still other advantages would be provided by an off-axis printing system with high reliability due to low vapor losses and air diffusion, yet with minimal tubing pressure drops while minimizing the force exerted by the tubing on the carriage to maintain accurate printhead alignment.

Only certain components of a printing composition delivery system, such as an off-axis ink delivery system of an ink-jet printer, are actually wetted by the printing composition. Other components are not. Components that are wetted include the printing composition supply station connector which connects to a supply of printing composition, such as a replaceable ink supply cartridge, and the printing member connector which connects to a printing member, such as a print cartridge. Another component that is wetted is conduit, such as one or more ink delivery tubes, which supplies printing composition from the printing composition supply to the printing member. Components that are not wetted include motors and electrical circuitry.

The ability to easily separate the wetted components of the printing composition delivery system from the unwetted ones would be a desirable improvement over the currently known art for several reasons. For example, wetted components of the printing composition delivery system must be leak-tight. Inspection, testing, and servicing of leak-tight components of the printing composition delivery system are simplified if these components are a separable unit from the printing composition delivery system. Additionally, wetted components in actual contact with the printing composition are more likely to be subject to corrosive action of printing composition solvents and may be rendered inoperable due to clogging of dried printing composition under certain long-term environmental conditions. The unwetted components of the printing composition delivery system may have longer life due to a lack of contact with the printing composition. The ability to remove a damaged module wetted by the printing composition and replace it with a new one prevents the need to replace the entire printing composition delivery system, including the undamaged portion or, alternatively, the entire printing device. This ability to replace only a module of the printing composition delivery system thus saves costs. It also increases expected reliability of repair because it eliminates the need for electrical connections to be made to replaced parts which can be fragile and subject to mechanical damage from things such as improper insertion or contamination from debris.

A further advantage of a replaceable module is that it enables use of different incompatible printing compositions in the same printing device by switching components of the printing composition delivery system which are wetted by the printing composition. Without such replacement, incompatible printing compositions could mix in the printing composition delivery system and cause failure or degraded performance of the printing device.

SUMMARY OF THE INVENTION

The present invention is directed to achieving these above-described advantages. An embodiment of the present invention is a module for a printing composition delivery system of a printing device. The printing composition delivery system includes a printing composition supply station attached to the printing device and having a printing composition supply. The printing device includes a printing member. The module includes a printing composition supply station connector, a printing member connector, and a flexible conduit for supplying printing composition from the printing composition supply of the printing composition supply station to the printing member. The printing composition supply station connector is releasably attached to the printing composition supply station and includes a coupler which is fluidly connectable to the printing composition supply. The printing member connector is releasably attached to the printing device and has a coupler which is fluidly connectable to the printing member. The flexible conduit includes a first end fluidly connected to the coupler of the printing composition supply station connector and a second end fluidly connected to the coupler of the printing member connector. The printing composition supply station connector, the printing member connector, and the flexible conduit are a separable unit from the printing composition delivery system.

The above-described aspects of the embodiment of the module of the present invention may be modified as follows. The module may additionally include a housing that covers a portion of the coupler of the printing member connector and encloses a portion of the flexible conduit adjacent the printing member connector. When the module includes the housing, the printing composition supply station connector, the printing member connector, the flexible conduit, and the housing are a separable unit from the printing composition delivery system. The housing provides mechanical support for the conduit and the printing member connector during insertion or removal of the module from the printing device, as well as during fluid connection of the printing member to the coupler of the printing member connector.

The housing and the printing member connector may be integral. The housing may include a conduit routing member. The printing device may include a carriage that is driven along an axis. In such cases the conduit routing member may be configured to include a first surface along the carriage axis and a second surface above the first surface. The housing may include a removable cover over the conduit routing member.

The module may additionally include a flexible conduit carrier in which the conduit is disposed that holds the conduit in an aligned manner. When the module includes the flexible conduit carrier, the printing composition supply station connector, the printing member connector, the flexible conduit, the flexible conduit carrier, and the housing are a separable unit from the printing composition delivery system.

The printing composition supply may include a plurality of printing composition supply cartridges and the printing device may have a plurality of printing members including printing cartridges. In such cases, the printing composition supply connector includes a plurality of couplers each of which is fluidly connectable to one of the printing composition supply cartridges. Additionally, the printing member connector includes a plurality of couplers each of which is fluidly connectable to one of the print cartridges. Furthermore, the flexible conduit includes a plurality of flexible tubes for supplying printing composition from the printing composition supply cartridges to the print cartridges, the flexible tubes each including a first end fluidly connected to one of the couplers of the printing composition supply station connector and a second end fluidly connected to one of the couplers of the printing member connector.

The coupler of the printing member connector may include a septum elbow. The coupler of the printing composition supply station connector may include a hollow needle for receiving printing composition from the printing composition supply and a biased plunger seal for sealing a connection between the needle and the printing composition supply.

The module of the present invention may be used in a printing device, including an ink-jet printing device.

As discussed above, the present invention also relates to a method of installing and removing a module for a printing composition delivery system. An embodiment of the method includes the steps of releasably attaching the printing composition supply station connector to the printing composition supply station and fluidly connecting the coupler of the printing composition supply station connector to the printing composition supply. The method additionally includes the steps of releasably attaching the printing member connector to the printing device and fluidly connecting the coupler of the printing member connector to the printing member so that the flexible conduit supplies printing composition from the printing composition supply of the printing composition supply station to the printing member.

The above-described aspects of the embodiment of the method of the present invention may be modified as follows. When the module include a housing that covers a portion of the coupler of the printing member connector and encloses a portion of the flexible conduit adjacent the printing member connector, the method may include the additional step of installing the housing in the printing device. When the printing device includes a carriage, the housing may be installed on the carriage of the printing device.

The method may further include the step of separating the module from the printing composition delivery system as a unit.

Other objects, advantages, and novel features of the present invention will become apparent from the following detailed description of the invention when considered in conjunction with the accompanying drawings.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 12 is a side cross-sectional view taken along line 12—12 of FIG. 4.

FIG. 13 is an isometric view of an off-axis supply manifold structure comprising the system of FIG. 3.

FIG. 14 is a cross-sectional view of a tubing set of the printing system of FIG. 3, taken along line 14—14 of FIG. 5.

FIG. 15 is a cross-sectional view of an alternate embodiment of a tubing set employed in the printer embodiments of this invention, wherein four tubes are defined in a common extrusion.

FIG. 16 is a simplified top view of an alternate printer embodiment in accordance with the invention.

FIG. 17 is a simplified front view of an alternate carriage manifold embodiment employed in the embodiment of FIG. 16.

FIG. 18 is a simplified partial isometric view of the carriage manifold embodiment of FIG. 17.

DETAILED DESCRIPTION OF THE PREFERRED EMBODIMENT

Overview of the Embodiments

An exemplary application for this invention is in an off-axis ink delivery system for a low end printing system. In the exemplary system, a scanning carriage moves a print head that fires ink drops in a dot matrix pattern onto a paper or other print medium. The print head is in fluid communication with a replaceable ink supply which is releasably mounted in a fixed ink supply station. Objectives of this system include the following:

(1) to provide a compact, low end printing system;

(2) to allow high throughput printing, with high flow rates through the tubing;

(3) to minimize pressure drops through the tubing;

(4) to maintain accurate print head alignment, by minimizing the forces exerted by the tubing on the print head carriage; and (5) to provide high reliability, through very low vapor losses and air diffusion through the tubing.

Figure 1:
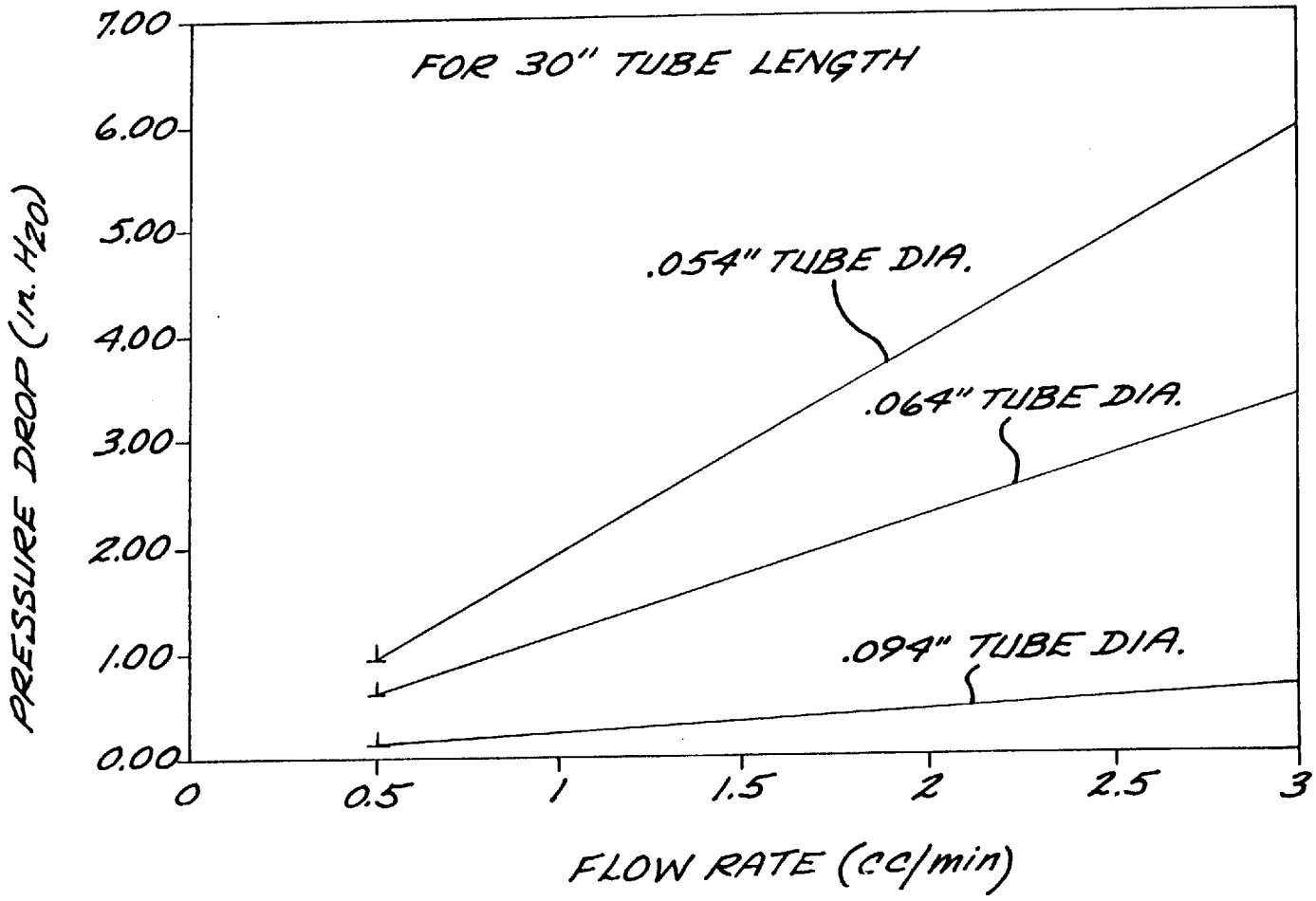
FIG. 1 is a graph showing results of characterization efforts of flow rates as a function of tube diameter for exemplary 3 centipoise ink.

The tubing requirements add to the difficulty of meeting these objectives. In order to minimize pressure drops, tubing with diameters larger than 0.050 inch ID (inner diameter) is desired, with a preferred inner diameter of 0.094 inches ID or larger for minimizing pressure drops. FIG. 1 is a graph showing results of characterization efforts of flow rates as a function of tube diameter for exemplary 3 centipoise ink. Moreover tube fitments become difficult when the diameter is below 0.0625 (1/16) inches. Smaller tubes are desired in order to allow for tube routing, since larger tubes exert more force and tend to kink when bent around tight corners. The requirement for low vapor losses and air diffusion requires tubing materials that have fairly high tensile modulus. For example, polychlorotrifluoroethylene (PCTFE) has a modulus of approximately 300,000 psi, and PCTFE copolymer has a tensile modulus of approximately 160,000 psi.

The effect of larger diameters and high modulus tubing materials has two deleterious effects. First, it sets a low limit on the radius of the tubing, which impacts printer size. Going below a certain bend radius increases the force exerted by the tubing on the carriage, which will adversely affect carriage alignment. In addition, the low bend radius can result in tubing buckling or fatigue failures. This militates toward smaller diameter tubing.

The off-axis ink delivery system in accordance with the invention embodies several aspects. According to one aspect of the invention, manifolding is used to route the ink fluid through ninety degree turns, which are not possible with tubing diameters greater than about 0.0625 inches ID. According to a second aspect of the invention, a stress relief clamp holding the tubing in place on the carriage is located near the slider rod to minimize the impact of the tubing on dot placement and carriage-to-carriage rod frictional forces. According to a third aspect of the invention, the overall tube path allows for the maximum dynamic bend radius during all carriage scan positions. The dynamic bend radius is the radius of the loop that varies as the carriage scans. This minimizes the tube stress loading on the carriage and minimizes the chances of exceeding tube fatigue or buckling limits. Further, the tube dynamic loop is never trapped between the carriage and a fixed wall and thus forced to a very small bend diameter. Instead, the tubing set is above the carriage and, in an exemplary embodiment, is allowed to stay at a 50 mm to 60 mm radius for the full travel of the carriage. A fourth aspect of the invention is the method of manifolding or stress relieving and heat forming to eliminate the tendency of the tube to kink when bent around a 90 or 180 degree bend, particularly important when a tube of diameter that allows for reasonable pressure drops is used and when the material provides high performance in a tubing application.

The tubing used in the ink delivery system should meet several objectives. It should have a very low vapor transmission rate (VTR) and very low air diffusion. The tubing modulus should be minimized to the extent possible while meeting the other objectives to minimize the force exerted on the carriage. The tubing should operate for many cycles of the carriage scanning back and forth, e.g. for millions of cycles for some applications, without failure. Finally, the tubing should be very low cost.

Figure 2:
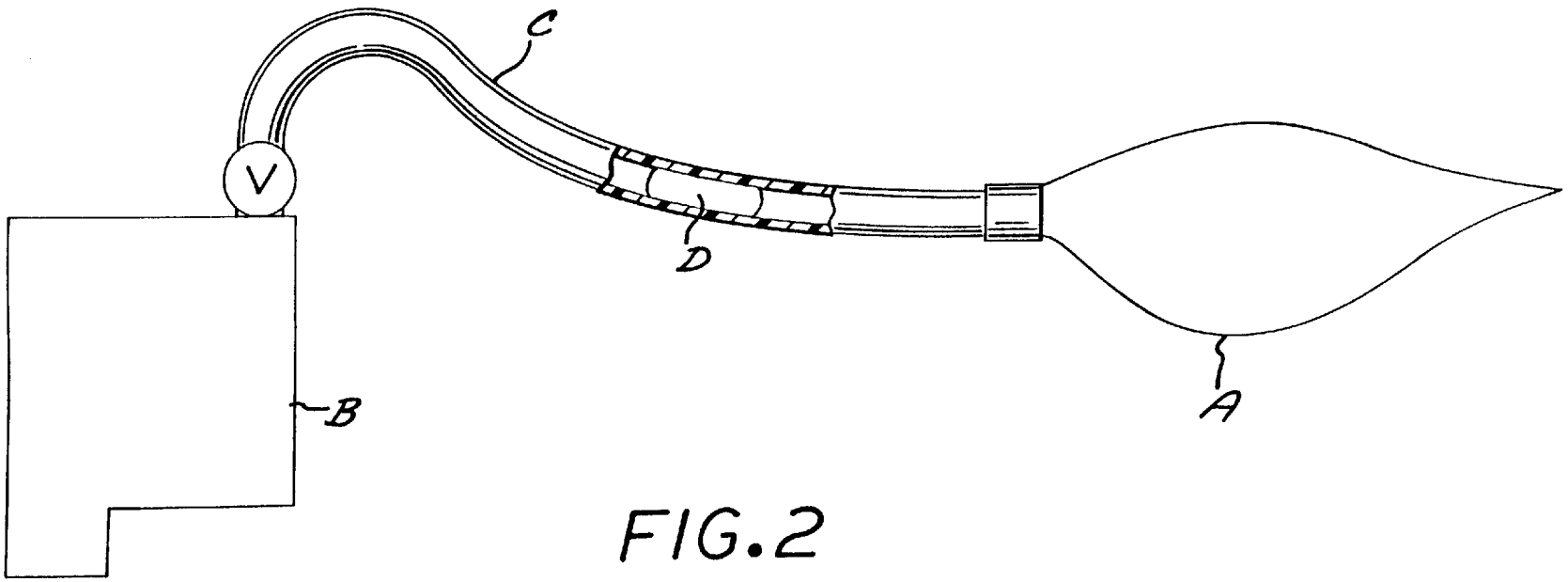
FIG. 2 is a simplified schematic diagram of a printer cartridge connected via a length of tubing to an off-axis ink reservoir represented as a flaccid bag, with an air bubble in the tubing to illustrate an air diffusion problem addressed by an aspect of the invention.

Air diffusion into the tubing is a more difficult problem to eliminate than that of volatiles escaping from the tubing and the ink partially concentrating and even partially drying in the tubing. Air ingestion is the growth of bubbles that are pre-existing in the tubing that is in fluid communication with a flaccid bag. The problem is illustrated in FIG. 2. Consider ink held in a flaccid closed bag A, and connected to a printing cartridge B through a tube C with an air bubble D. The outside atmosphere, the total pressure in the bag, and the bubble total pressure are equalized (assume they are level and static):

$$P_{tot,\ tube}=P_{tot,\ bag}=P_{tot,\ outside}$$

Now, total pressure equals air (primarily oxygen and nitrogen, not counting vapors) pressure plus partial pressure of vapor:

$$P_{tot,\ tube}=P_{air,\ tube}+P_{vapor,\ tube}+P_{air,\ outside}+Pvapor,\ outside$$

Thus, $$(P_{air,\ outside}-P_{air,\ tube})=(P_{vapor,\ tube}-P_{vapor,\ outside})$$

Now, the vapor air in the tube is fully saturated; however, the pressure of vapor outside may vary. In Arizona, for example, the vapor pressure may be very low. In Florida, it would typically be very high. In very dry environments, such as Arizona, the diffusion rate of air can be very high. With low performance tubing materials, the tubes can fill with air in a few days. The air in the tubing will be drawn into the print cartridge, causing starvation of the printhead or dysfunction of the regulator.

According to an aspect of the invention, a tubing has been employed in the printing system embodying the invention which meets the above objectives. One presently preferred tubing material suitable for the purpose is Polyvinylidene Chloride copolymer (PVDC). The tubing is manufactured using known extrusion processes for making tubing. The PVDC materials known to be extrudable and exhibit good oxygen and water barrier properties, insofar as presently known, tend to include a ratio of approximately 80% vinylidene chloride monomer and 20% vinyl chloride monomer. There are typically additional standard polymer materials added to this ratio to aid in the extrusion process or provide additional important properties such as flexibility; the addition of such materials is known in the art. PVDC copolymer materials suitable for the purpose are commercially available. For example, Dow Chemical markets materials under the trademark "Saran." Versions of "Saran" that appear to be suitable for the purpose include "Saran 2032," "Saran 32056," and "Saran 313," all trademarks of Dow Chemical.

Other materials known to applicants which can be used for the tubing application include PCTFE copolymer and ECTFE (ethylenechlorotrifluoroethylene). These materials have exemplary characteristic values given in Table I below, with a water vapor transmission rate (WVTR) (gram-mil/100 inches$^2$-Day) at 10% relative humidity (RH), 100° F.; $O_2$ permeability (cc·mil/(100 in$^2$·day·atm), 23° C., 0% RH); tensile modulus (psi), where psi represents pounds per square inch. The foregoing units of measure are well known in the art. Moreover, these materials exhibit good fatigue and chemical resistance, and are relatively low cost.

TABLE I

| Property | ECTFE | PCTFE copolymer | PVDC |
|---|---|---|---|
| WVTR | 0.45 | 0.027 | 0.25 |
| $O_2$ Perm. | 20 | 12 | 2.5 |
| Tensile mod | 240,000 | 160,000 | 65,000 |

While in a preferred embodiment, the tubing is formed as an extrusion consisting of the selected low diffusion material, the tubing can alternatively be formed as a multi-layered tube, wherein the tubing is fabricated of a layer of very flexible polymer material, and another layer of PVDC copolymer or other low diffusion material.

Exemplary Printing System Embodiments

Figure 3:
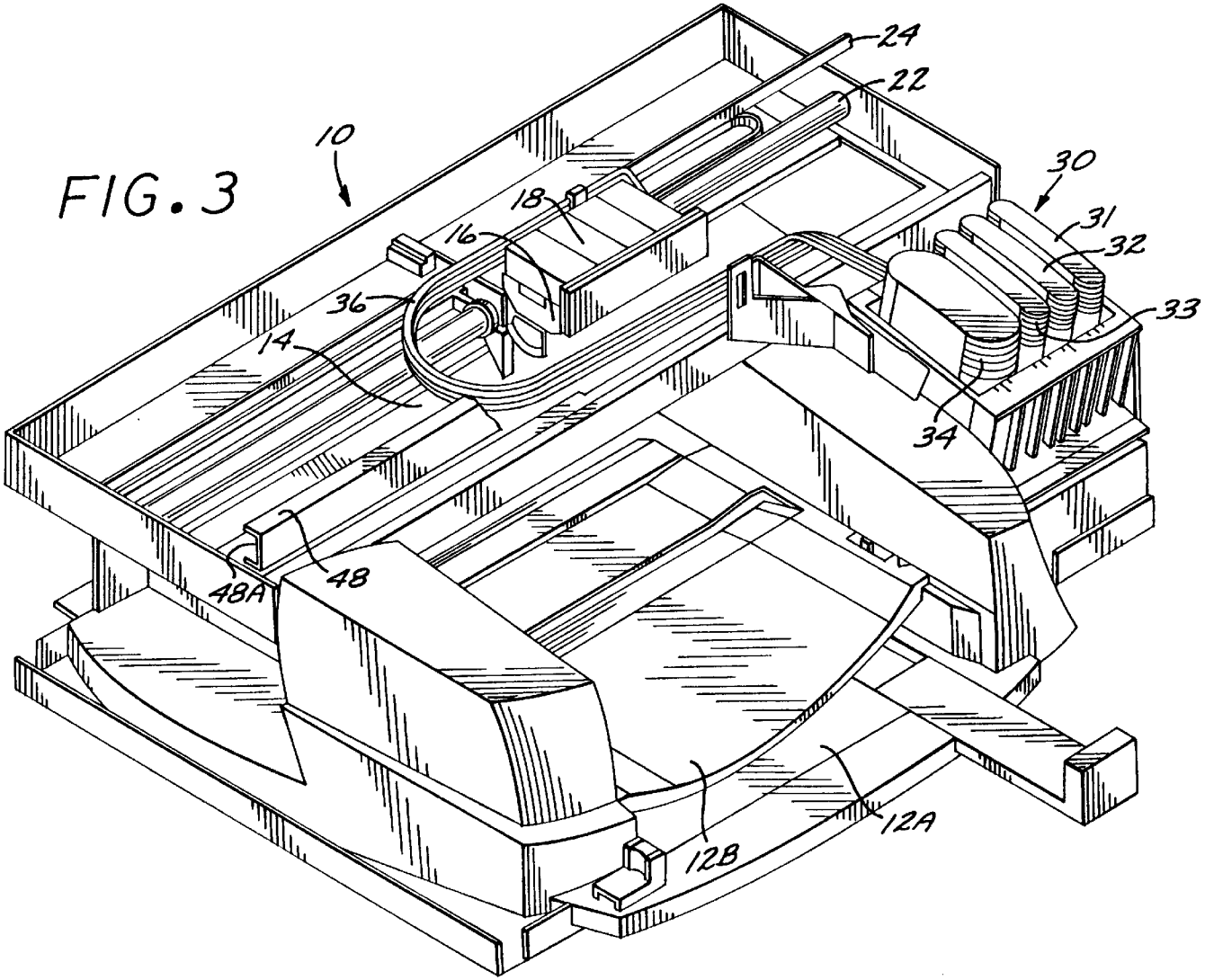
FIG. 3 is a perspective view of a color ink-jet printer embodying the invention, with its cover removed.

Turning now to FIG. 3, a perspective view is shown of an exemplary embodiment of an ink-jet printer embodying the invention, with its cover removed. Generally the printer 10 includes a tray 12A for holding an input supply of paper or other print media. When a printing operation is initiated, a sheet of paper is fed into the printer using a sheet feeder, and then brought around in a U direction to travel in the opposite direction toward output tray 12B. The sheet is stopped in a print zone 14, and a scanning carriage 16, containing one or more print cartridges 18, is then scanned across the sheet for printing a swath of ink thereon. After a single scan or multiple scans, the sheet is then incrementally shifted using a stepper motor and feed rollers (not shown in FIG. 3) to a next position within the print zone 14, and carriage 16 again scans across the sheet for printing a next swath of ink. When printing on the sheet is complete, the sheet is forwarded to a position above the tray 12B, held in that position to ensure the ink is dry, and then released.

Alternate embodiments of the printer include those with an output tray located at the back of the printer 10, where the sheet of paper is fed through the print zone 14 without being fed back in a U direction.

The carriage 16 scanning mechanism may be conventional, and generally includes a slide rod 22, along which carriage 16 slides, and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

Novel features of the ink-jet printer 10 relate to the ink delivery system for delivering ink to the print cartridges 18 from an off-axis ink supply station 30 containing replaceable ink supply cartridges 31, 32, 33 and 34. For color printers, there will typically be a separate ink supply station for black ink, yellow ink, magenta ink, and cyan ink. Since black ink tends to be depleted most rapidly, the black ink supply 34 has a larger capacity than the capacities of the other ink supplies 31–33.

A tubing set 36 of four tubes 38, 40, 42 and 44 carry ink from the four off-axis ink supply cartridges 31–34 to the four print cartridges 18. In accordance with one aspect of the invention, the tubes 38–44 are formed of a PVDC copolymer. Other materials are also suitable for the purpose, including ECTFE, such as Halar™, and PCTFE copolymer, such as Aclon 3000™. Such tubing materials provide the necessary barrier to air diffusion, and meet the other criteria discussed above for the tubing.

Figure 4:
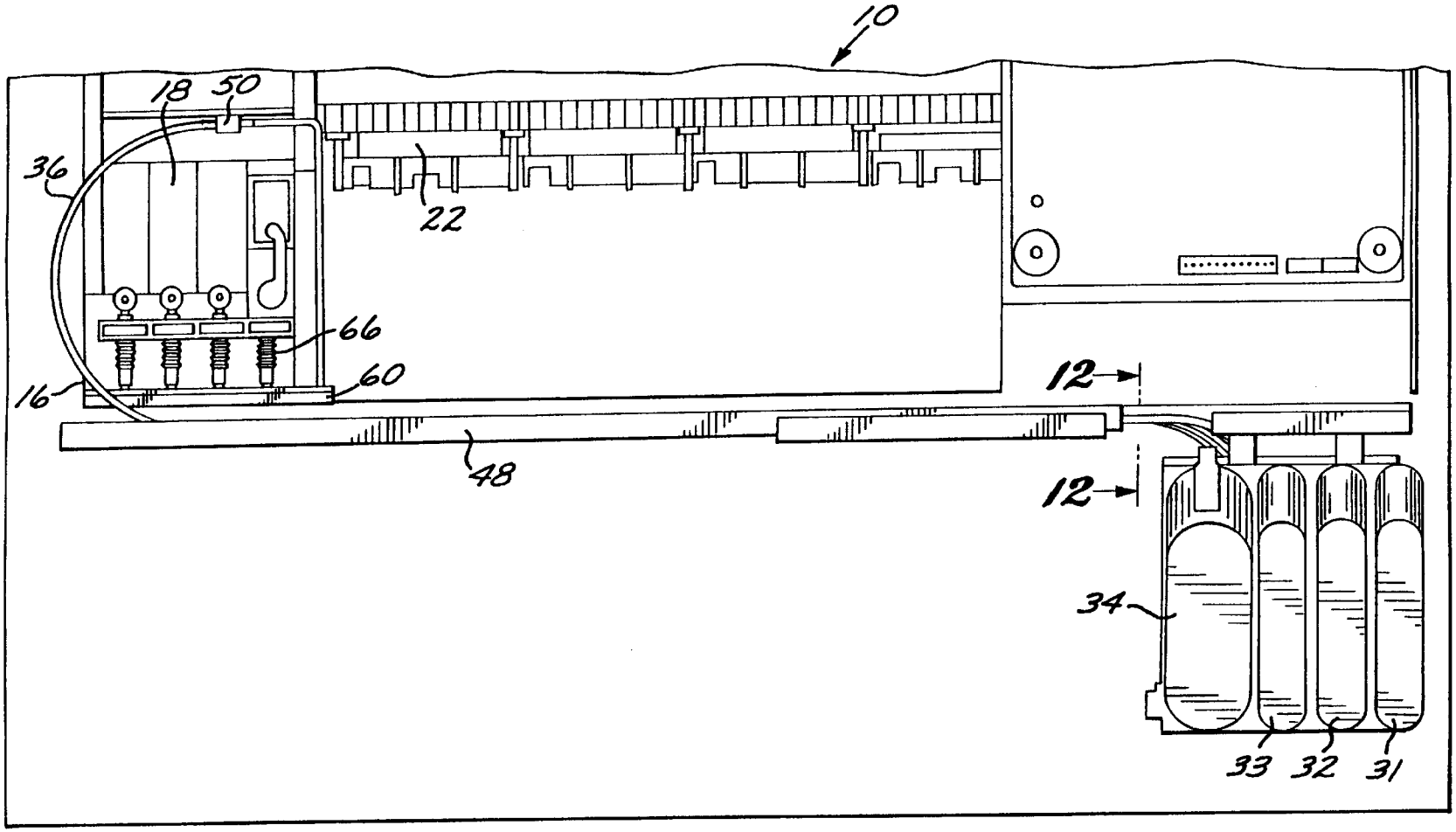
FIG. 4 is a simplified, partial top view of the printer of FIG. 3, showing a routing of the ink supply tubes from the off-axis ink reservoirs to the carriage-mounted ink cartridges.

FIG. 4 is a top view of the printer 10 of FIG. 3. This shows the tube routing of the tubing set 36 according to a further aspect of the invention. The tube routing is designed to accommodate the tubing set while minimizing the space needed for the tubing set 36 to follow the carriage 16 along its scanning path. In this exemplary embodiment, the tubes 38–44 are secured together in a flat ribbon intermediate the tube ends. This can be achieved by a flexible tubing carrier 46, fabricated of a flexible plastic material with tube-receiving channels 46A–46D formed therein, sized so that the individual tubes snap fit into the channels, as shown in FIG. 14. An exemplary material for fabrication of the tube carrier is polyurethane. Alternatively, the four tubes 38–44 can be fabricated of an integral extrusion 36', wherein the tubes are joined together by portions of the extrusion. This alternate embodiment is shown in FIG. 15.

The tubing set 36 runs from the individual off-axis cartridges 31–34 to the carriage mounted cartridges 18 in a run length of approximately 25 to 30 inches for a small printer, with about 26–28 inches in the exemplary embodiment. The inner tube diameter is in the range of 0.030 to 0.150 inches, depending on the required ink flow rates, with 0.054 to 0.094 inches the preferred range, and about 0.064 inches an exemplary preferred diameter of the tubing for the printer 10. The tubing outer wall thickness is preferably in the range of 0.010 inch to 0.020 inch, with a preferred value of 0.015 inches. The tubing bend stress versus air diffusion requirements tends to define this value.

The tubing set 36 runs in a C-shaped channel guide 48 which is open along a side facing the print zone 14. A clamp (not shown) located at the off-axis supply end of the channel guide secures the position of the tubing set 36 relative to this end of the guide. The channel guide 48 constrains the tubing set 36 such that it cannot move further away from the print zone 14 than the upright wall 48A of the member 48, yet permits the tubing set 36 to move out of the channel guide as needed to follow the movement of the carriage 16.

Figure 5:
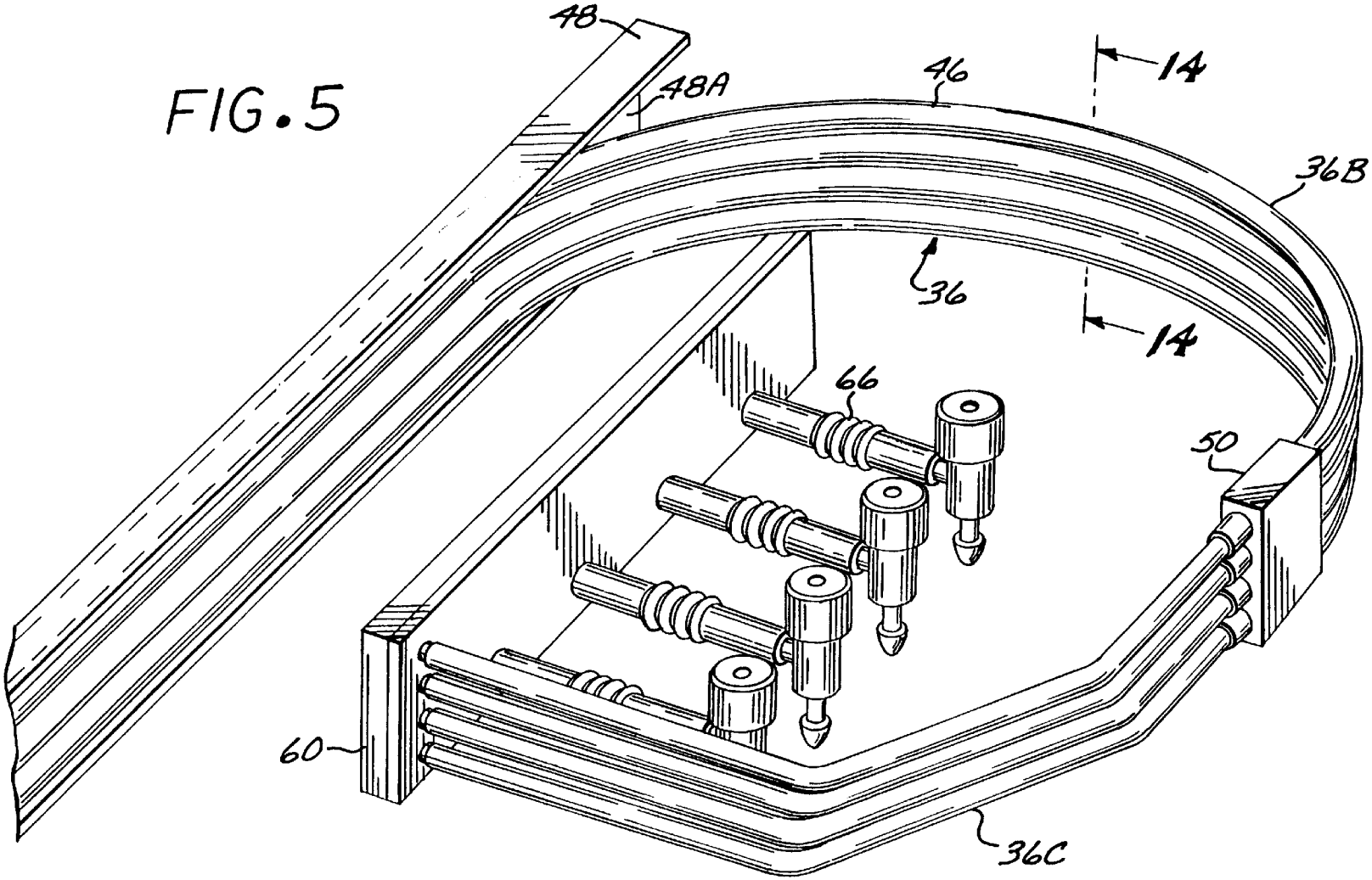
FIG. 5 is an isometric view of the carriage manifold and the connection to the tubing set.
Figure 6:
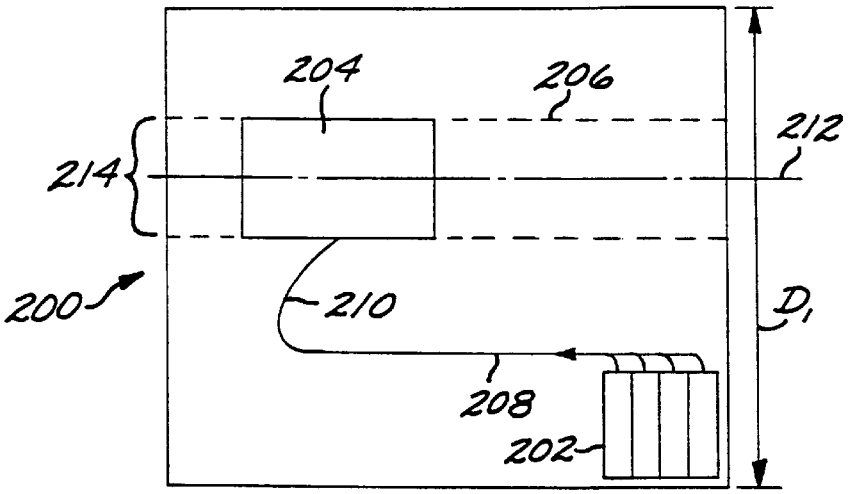
FIG. 6 is a simplified top view of a printer with an off-axis ink supply station and a scanning carriage.
Figure 7:
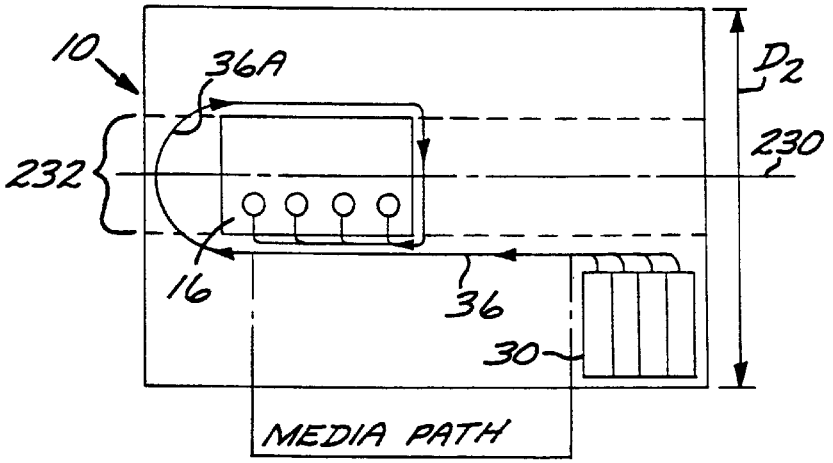
FIG. 7 shows a highly simplified top view of the printer of FIG. 3, illustrating the carriage, the vertical plane passing through the nozzle arrays of the printheads carried on the carriage, the off-axis ink supply station and tubing set.

The tubing set 36 is clamped upright to the carriage 16 by a stress relief clamp 50, and so the tubing set 36 includes an off-carriage portion 36B and an on-carriage portion 36C, divided by the clamp 50. The tube carrier 46 terminates at the stress relief clamp. The tubing set 36 is bent upwardly in this exemplary embodiment from the level of the carriage 16 to the level of the channel member 48. This upward curve is accomplished by bending the tubes 38–44 to make the transition from a horizontal plane at carriage level to an upper horizontal plane at the channel guide 48. Downstream of the clamp 50, the ends of the tubes 38–44 are respectfully connected to input ports of a plastic manifold 60, which routes the ink through corresponding channels to manifold output ports, including port 62A shown in FIG. 9. The manifold output ports are in turn then fluidically coupled to the corresponding print cartridges 18 via ink couplers 66 and needle/septum arrangements, as shown in FIG. 5. An important tube routing feature embodied in the printer 10 is that the tube set 36 is routed between the off-axis ink supply and the print cartridges on the carriage 16 such that a loop is formed in the tubing set, and wherein a projection of the loop substantially overlaps a corresponding projection of the carriage. It can also be said that, for many applications, the loop is substantially contained within a vertically projected volume swept out by the carriage as it scans through its path of travel. This routing permits a reduction in the depth of the depth size of the printer. This feature is shown in FIG. 6 and FIG. 7. FIG. 6 illustrates a simplified top view of a printer 200 with an off-axis ink supply station 202 and a scanning carriage 204. The vertical projection of the carriage scan swept volume is indicated as 214. A vertical plane 212 bisects the printhead nozzle arrays on the carriage 202, and is parallel to the scan axis of the carriage. The tubing 208 provides a fluid path from the off-axis ink supply station 202 and the carriage 204, with a loop 210 formed in the tubing. It is noted that the tubing does not cross the vertical plane 212 between the off-axis ink supply and the carriage, and the dynamic loop 210 formed by the tubing lies mostly outside of the vertical projection of the carriage scan swept volume. Thus, the tubing takes up additional product volume beyond the carriage swept volume. The printer has a depth indicated at $D_1$. To reduce the volume necessary to accommodate the loop, a low performance tubing material is generally used, such as LDPE tubing, which has a relatively low modulus and thus permits loops with very small bend radii, say on the order of 20 mm. The low performance tubing can permit high air ingestion rates, leading to printing difficulties.

Now consider FIG. 7, which shows a highly simplified top view of the printer 10, illustrating the carriage 16, the vertical plane indicated as numeral 230 passing through the nozzle arrays of the printheads carried on the carriage, the off-axis ink supply station 30 and tubing set 36. A loop 36A is formed in the tubing set. The loop 36A is larger than the loop 210 formed in the tubing 208 of FIG. 6. Yet in spite of the larger loop, say on the order of 50–60 mm, the net increase in printer space due to the larger loop is negligible. This is because the vertical projection of the loop 36A along the media path direction is substantially contained with the vertical projection of the carriage scan swept volume, indicated as 232. In fact the tubing 36 crosses the axis 230 twice in this exemplary embodiment. This is also true for a vertical plane parallel to the scan direction and that goes through the carriage center of mass; plane 230 can also represent such a plane through the center of mass. The vertical projection of the dynamic loop 36A formed in the tubing set 36 will lie substantially within the vertical projection of the swept volume of the carriage as it passes between its right and left limits of travel. (It is the vertical projection of the loop because the loop must stay out of the way of the carriage.) As a result, the depth $D_2$ of the printer 10 can be reduced in comparison to the depth $D_1$ of the printer shown in FIG. 6. In other words, the tube routing configuration of FIG. 7 is space saving because the loop does not add to the depth (measured along the media advance axis) of the printer, even though the loop has a fairly large radius.

Figure 8:
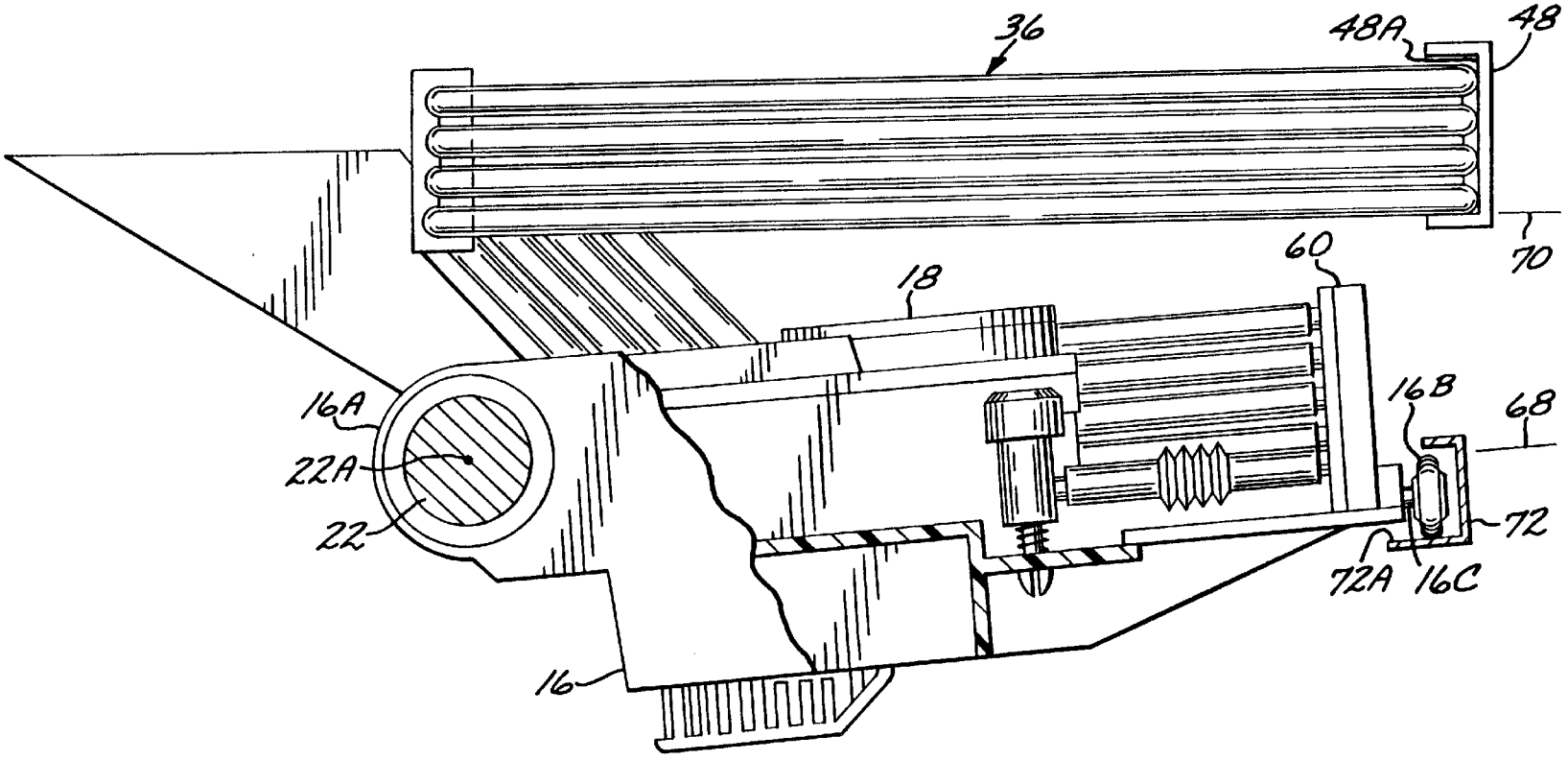
FIG. 8 is a partially broken-away side view of the carriage, slider rod and tubing set of the printer of FIG. 3 in isolation.

FIG. 8 is a partially broken-away side view of a portion of the printer of FIG. 3, showing the slider rod 22, the carriage 16 with print cartridges, the tubing set 36, and the tubing guide. FIG. 8 shows the change in plane of the tubing routing from the carriage plane to a higher plane. The change in plane facilitates a narrow form factor for applications which are sensitive to printer depth. The change in plane also allows placement of the supplies above the carriage which helps throughput by providing extra pressurization on the ink delivery system. It is noted that the carriage 16 is not strictly horizontal, but is slightly tilted from the horizontal as shown in FIG. 8. The position of the rear side of the carriage relative to the rod axis 22A is constrained by the slider rod 22, which is received within a rod receiving structure 16A comprising the carriage 16. The position of the front side of the carriage is determined by an idler wheel 16B which rotates freely on a shaft 16C. Gravity urges the wheel 16C against a lower surface 72A of a guide 72 fixedly attached to the printer housing structure. It is possible for the carriage to rotate to a small degree about the rod 22, against the force of gravity. This can happen if the carriage is subjected to forces urging the front side of the carriage upwardly. Such rotation of the carriage would adversely affect the print quality, since the alignment of the printhead relative to the print media would be affected. It is an object of this invention to minimize the forces applied to the carriage by the tubing set which could tend to lift the wheel off the surface 72A, while at the same time minimizing the size of the printer. This is accomplished by the routing of the tubing set, the selection of the tubing material and diameter and thickness of the tubes.

Figure 9:
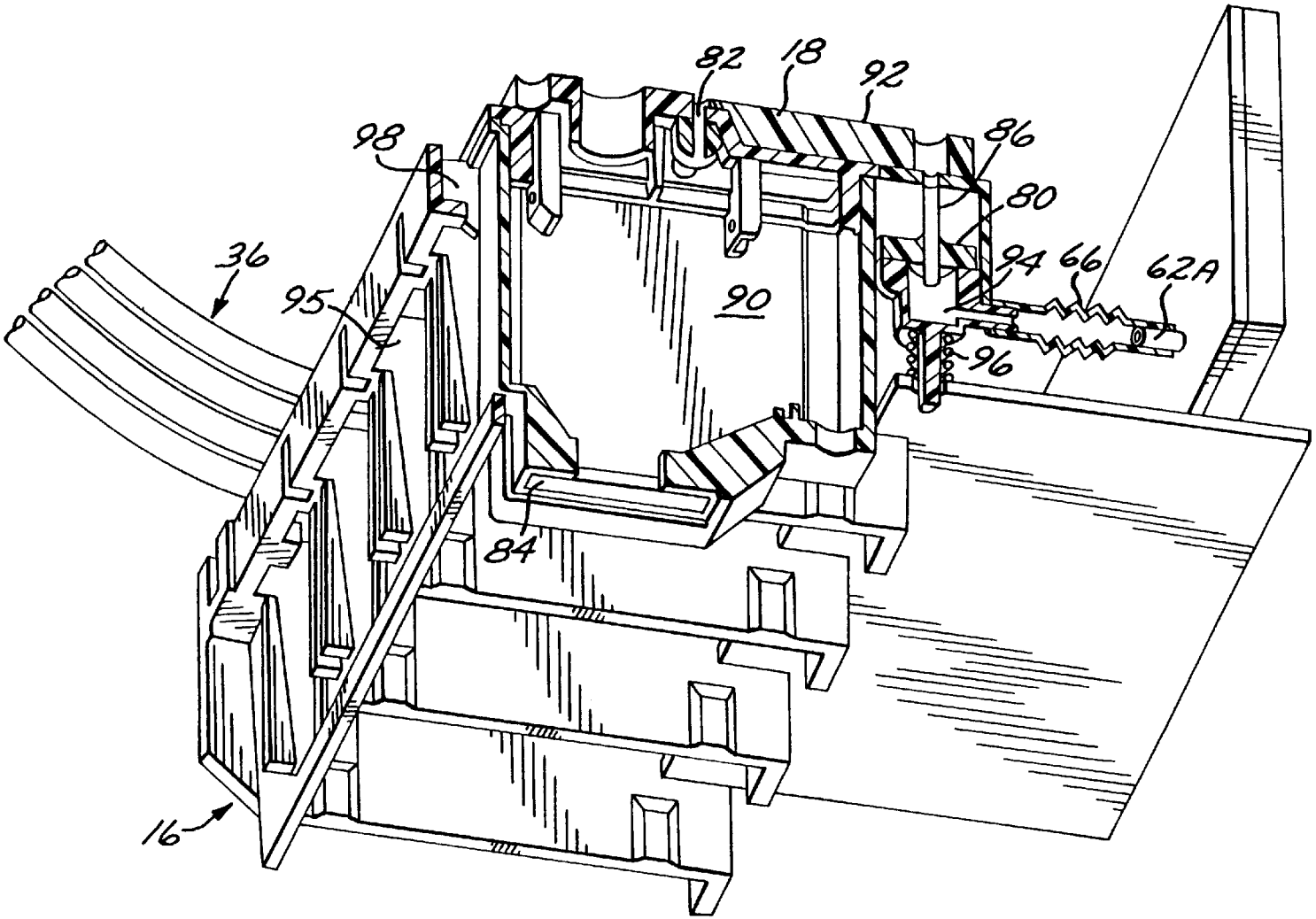
FIG. 9 is an isometric, partially broken-away view of the carriage with printer cartridges comprising the printer of FIG. 3.

FIG. 9 is an isometric view looking up at the carriage 16, showing a print cartridge 18 and septum 80 in cross-section. Not shown in this cross-section is a regulator valve within the print cartridge which regulates the pressure by opening and closing hole 82. An opening in the bottom of the carriage 16 exposes the printhead location 84 of each print cartridge 18. Carriage electrodes (not shown) oppose contact pads on the print cartridge 18. When the regulator valve is opened, a hollow needle 86 is in fluid communication with an ink chamber 90 internal to the cartridge 18. The needle 86 extends through a self-sealing slit formed in through the center of the septum 80. The slit is automatically sealed by the resiliency of the rubber septum 80 when the needle is removed. A plastic conduit 92 leads from the needle 86 to chamber 90 via hole 82. The conduit may also be integral to the print cartridge body. The conduit may be glued, heat-staked, ultrasonically welded or otherwise secured to the print cartridge body. A septum elbow 94 routes ink from the manifold 60 to the septum 80, and supports the septum. The septum is affixed to the elbow using a crimp cap. The coupler 66 in this exemplary embodiment is a flexible bellows for allowing a degree of x, y and z movement of the septum 80 when the needle 86 is inserted into the septum to minimize the load on the needle and ensure a fluid-tight and air-tight seal around the needle. The bellows may be formed of butyl rubber, high acn nitrile or other flexible material having low vapor and air transmission properties. Alternatively, the bellows can be replaced with a U-shaped or circular flexible tube. A spring 96 urges the septum 80 upwardly, allowing the septum to take up z tolerances, minimizes the load on the needle and ensures a tight seal around the needle 60. Slots 98 formed on each of the stalls 95 in the carriage 16 align with tabs on each print cartridge 18 to restrict movement of the print cartridge 18 within the stall.

Figure 10:
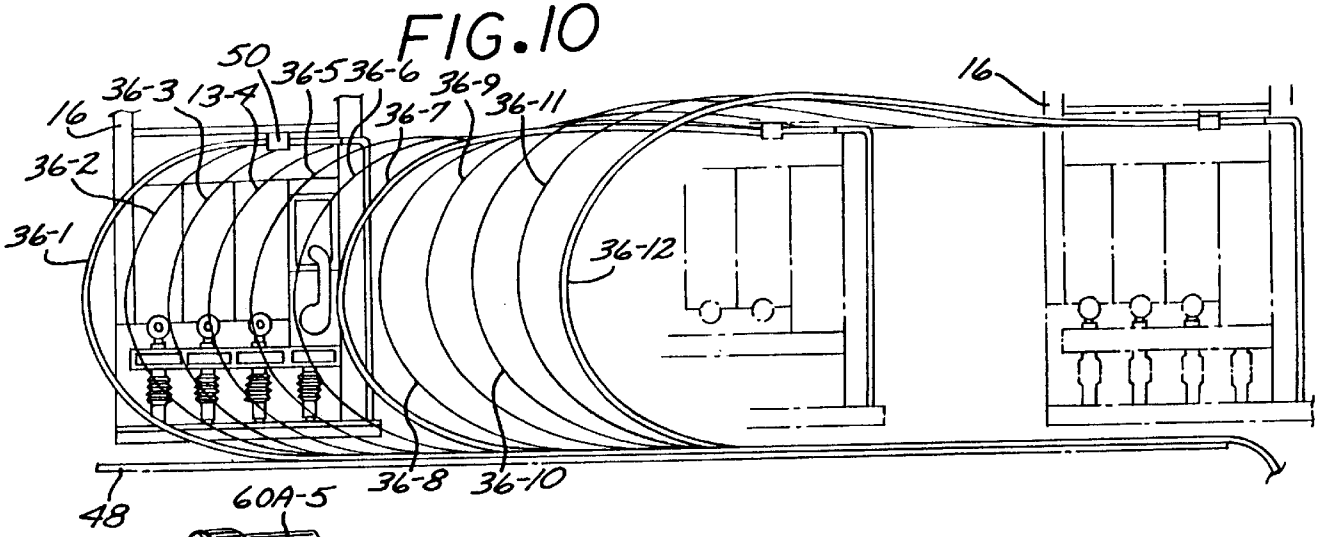
FIG. 10 is a simplified, partial top view of the printer of FIG. 3, showing the position of the tubing set at various carriage positions in its scanning range of motion.

FIG. 10 is a simplified, partial top view of the printer of FIG. 3, showing the position of the tubing set 36 at various carriage positions in its scanning range of motion. At a first carriage position disposed at a first end of the scanning range of motion located away from the off-axis ink supply station 30, the tubing set 36 has the position illustrated as 36-1 in FIG. 10. As the carriage 16 is scanned from the first end of the scanning region to the second end of the scanning region, the tubing set assumes a continuum of positions including the exemplary discrete positions 36-2 through 36-12 shown in FIG. 8. The outer (i.e. away from the area scanned by carriage 16) travel limit of the tubing set 36 is bounded by the channel guide 46 on one longitudinal side of the area scanned by the carriage 16. The outer travel of the tubing set 36 on the opposite longitudinal side of the scanned area is constrained by the stress relief clamp 50 which, at tubing position 36-1, results in the vertical projection of the tubing set 36 substantially containing the carriage 16, yet without the tubing extending past the side of the carriage over the slider rod 20. As the carriage is scanned toward the opposite end of its travel, additional length of the tubing set 36 becomes available to form a somewhat larger loop which does slightly protrude over the side of the carriage over the rod 20, as shown at carriage position 36-12, for example. The printer volume required to accommodate the tubing set is minimized due to the efficient tube routing scheme shown in FIG. 10.

Figure 11:
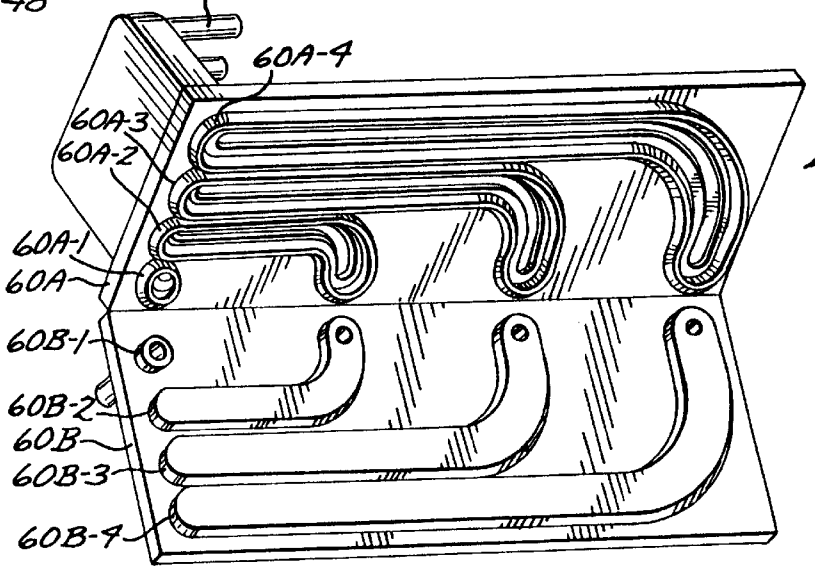
FIG. 11 is an isometric, exploded view illustrating the carriage manifold employed in the printer of FIG. 3.

FIG. 11 is an exploded view of the carriage manifold 60 of the system of FIG. 3. In this embodiment, the manifold is shown to comprise two matching plastic manifold parts 60A and 60B with corresponding channel-defining structures, which when joined together define four leak-resistant fluid channels between an input port connected to a corresponding tube, and an output port connected to a fluid coupler for connection to the corresponding printing cartridge mounted in the carriage. One input port is shown as a short connector tube 60A-5. One output port is shown as short connector tube 60B-8. The two parts of the manifold are joined together with ultrasonic welding, adhesive or other sealing techniques to ensure a lead-resistant joinder between the two parts. Ultrasonic welding is a preferred method of assembly of the manifold, using tongue and groove joints as illustrated. An exemplary material from which the manifold can be constructed is DOW Isoplast 302, a polyurethane.

FIGS. 12 and 13 illustrate an exemplary technique for achieving a fluidic connection between an exemplary off-axis ink cartridge 34 and its corresponding tube 42. A hollow needle 112 extends from an off-axis manifold 110 at a stall in the off-axis supply station 30, and is connected to input port 114 of the manifold via a 90 degree conduit 116 defined in the manifold. The ink within the off-axis cartridges 31–34 is at atmospheric pressure in this exemplary embodiment, and ink is drawn into each of the print cartridges 18 by a negative pressure within each cartridge 18 determined by a regulator internal to each print cartridge. The hollow needle 112 extends in an upward direction from the ink supply support provided by the manifold 110, and is inserted through a rubber septum 120 on the ink supply cartridge 34 to create a fluid communication path between the ink reservoir 122 within the cartridge 34 and the ink conduit 116. In one embodiment, the ink reservoir 122 comprises a collapsible ink bag. The off-axis manifold 110 includes input ports, upwardly extending hollow needles and internal 90 degree fluid conduits for each of the other supply cartridges 31–33 at the supply station 30, as generally indicated in FIG. 13.

It is noted that, for the printer of FIG. 3, a fluid conduit is established between the printer cartridges on the carriage and the off-axis ink supply reservoirs. Depending on the particular implementation, the fluid conduit can include the fluid outlet from the off-axis reservoir, the manifolds at the carriage and off-axis ink supply, the tubing, the fluid coupler between the carriage manifold and the cartridge reservoir. In general, the fluid conduit includes the entire fluid path between the off-axis reservoir and the carriage mounted cartridge.

FIG. 16 is a top view of an alternate printing system embodiment 10', wherein the channel guide 46' is mounted on the opposite side of the print zone from the location of the guide 46 of the printer embodiment of FIG. 4. Thus, the channel guide 46' is mounted adjacent to and above the slider rod 22. The carriage end of the tubing set 36 is connected to the carriage manifold 150, located on the carriage side opposite the channel guide 46'. A stress relief clamp 50' is mounted to the carriage 16' to fix a section of the tubing set 36 to the carriage, as shown in FIG. 16. A disadvantage of the embodiment 10' is that the stress relief clamp 50' is not located adjacent the slider rod 22. Any forces exerted by the tubing set 36 as the carriage is scanned will more readily be transferred into forces tending to pull the idler wheel 16B off the guide surface of guide 72, thus adversely affecting alignment of the printing cartridges relative to a print medium. However, the tube routing of the tubing set 36 is quite efficient, thus minimizing printing system size.

FIGS. 17 and 18 show the alternate form of manifold 150 in further detail. The manifold 150 includes a 90 degree elbow turn on each of the inlet ports 152, so that the tubing set 36 essentially runs parallel to the face of the manifold, instead of meeting the manifold transversely relative to the face of the manifold, as in the embodiment of FIG. 3. Moreover, the distance of each inlet port from the face 154 of the manifold is staggered, thereby facilitating the turning and changing of elevation of the tubing set 36 as it is routed from the carriage to the off-axis ink supply station. In an exemplary embodiment, the fitment stagger of the manifold defines a 15 degree angle, with 4.5 mm spacing between fitments (manifold output ports). There are a plurality of manifold output ports 156, which are coupled to the print cartridges on the carriage via fluid couplers (not shown). The manifold 150 has four internal fluid conduits providing a fluid path from each inlet port to a corresponding output port. The manifold 150 provides essentially three 90 degree changes of direction of the ink path. The manifold 150 can be fabricated of two elements which are fixed together, in a similar fashion as the construction of manifold 60.

Figure 19:
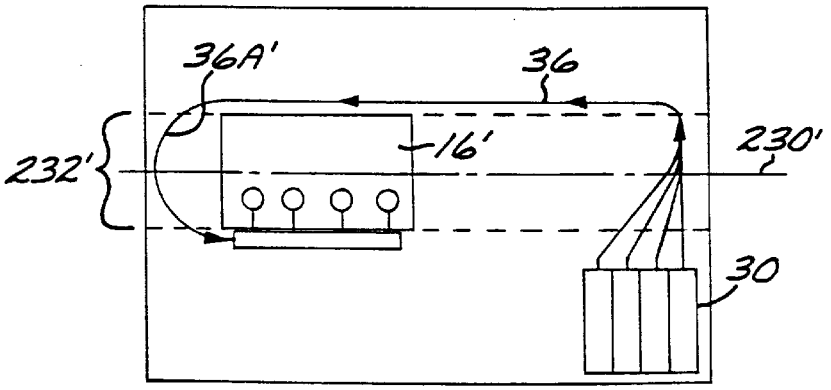
FIG. 19 is a highly simplified top view of the printer embodiment of FIG. 16, corresponding to FIG. 7.

FIG. 19 is a simplified top view of the printer 10' of FIG. 16, and is corresponds to FIG. 7. Here again, the vertical projection of the dynamic loop 36A' will be substantially contained within the vertical projection of the carriage swept volume 232', and crosses the vertical plane 230'.

Figure 21:
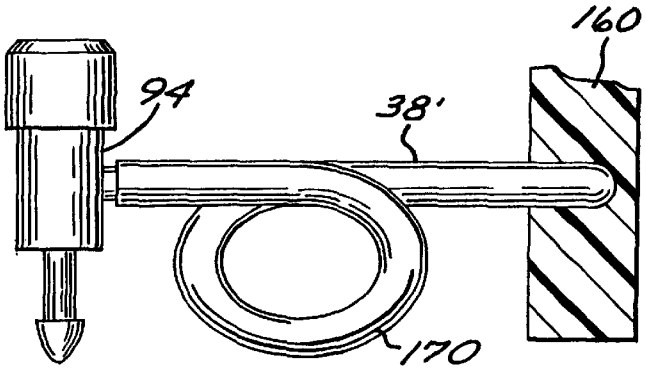
FIG. 21 is a cross-sectional view taken along line 21—21 of FIG. 20.
Figure 22:
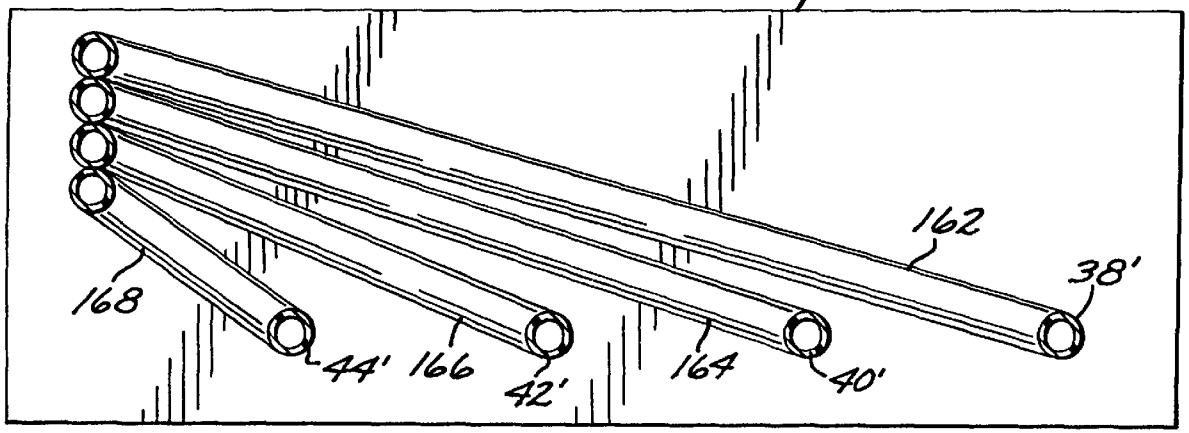
FIG. 22 is a cross-sectional view taken along line 22—22 of FIG. 20.
Figure 20:
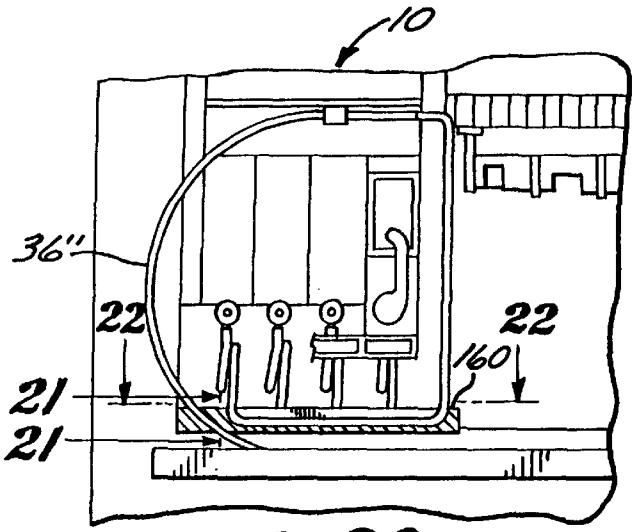
FIG. 20 is a top view of a portion of an alternate printing system embodying a tube forming feature.

FIGS. 20–22 illustrate an alternate embodiment of a fluid coupler for coupling between the ink supply station and the printing cartridges. This embodiment employs heat forming to form ends of the tubing set into shapes facilitating direct connection to the septum elbow 94, eliminating the need for a separate fluid coupler 66 and a manifold 60 as in the embodiment of FIG. 3. A further advantage is the elimination of the fluid connections for each tube, i.e. the tube-to-manifold connection and the manifold-to-coupler connection, thereby reducing ink leak risks. FIG. 20 is a top view of a portion of a printing system 10" embodying this tube forming feature, wherein the tubing set 36" has tube ends formed in the requisite shape to lead to the septum elbow 94 through a stress relief structure 160. The cross-sectional views of FIGS. 21 and 22 further illustrate the formed tube ends and the structure 160. The structure 160 is a plastic member having a plurality of channels 162–168 formed therein of a size to receive a corresponding tube 38'–44' therein in a press fit. The channels thus hold portions of the tubes in place for stress relief, with end portions of the tubes protruding therefrom for connection to the corresponding septum elbow. The protruding tube portion has a loop formed therein to provide compliance to facilitate the connection to the septum elbow. For example, as shown in FIG. 21, tube 38' has a loop 170 formed therein.

Figure 23:
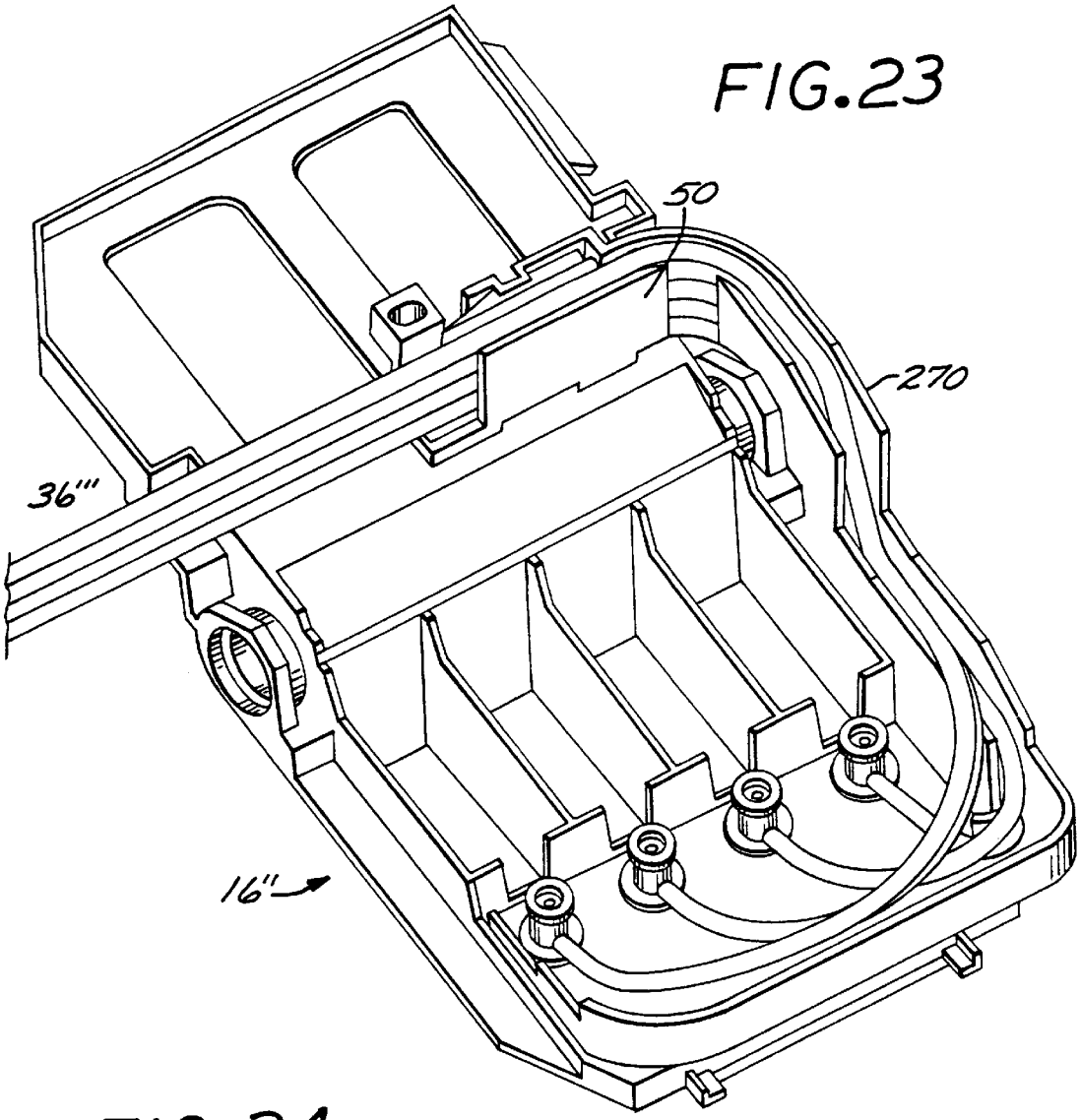
FIG. 23 is an isometric view of a further embodiment of a printer carriage and tube routing configuration.
Figure 24:
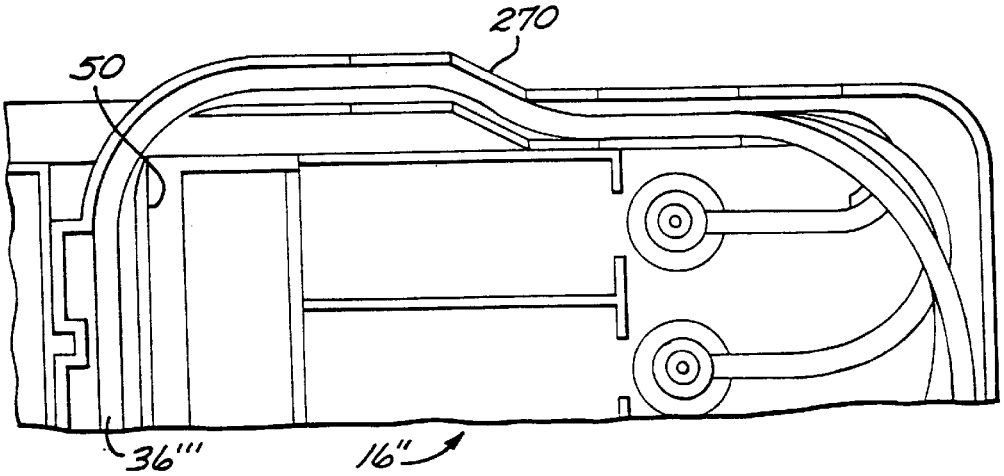
FIG. 24 is a partial top view of the printer carriage and tube routing configuration of FIG. 23.

FIGS. 23 and 24 illustrate yet another embodiment of the tube routing aspect of the invention. Here the carriage 16" is intended for use in a tube routing configuration similar to that shown in FIGS. 3–4. The carriage 16" further includes a tube routing member 270 which guides the tubing set 36'" to transition planes from the stress reliever 50 located on the top surface of the carriage down to the level of the septum elbows to which the ends of the tubes are directly connected. The tubes comprising the tubing set 36'" can be heat formed to assume the curvature shown in FIGS. 23 and 24. The embodiment of FIGS. 23 and 24 also do not require a separate ink manifold, and therefore eliminate two fluid connections per tube.

The heat forming of the tubes can be obtained by preshaping the tubing, holding the tubing in the preshaped position, and then heating the tubing. Hot air, radiant heating, or a hot forming tool can be used to heat the tubing. One way to obtain the proper shape is to place the tubing into the tube routing member of FIG. 23.

The tubes can then be heated, e.g. by directing a hot air blast at the tubing to relieve stress.

Figure 25:
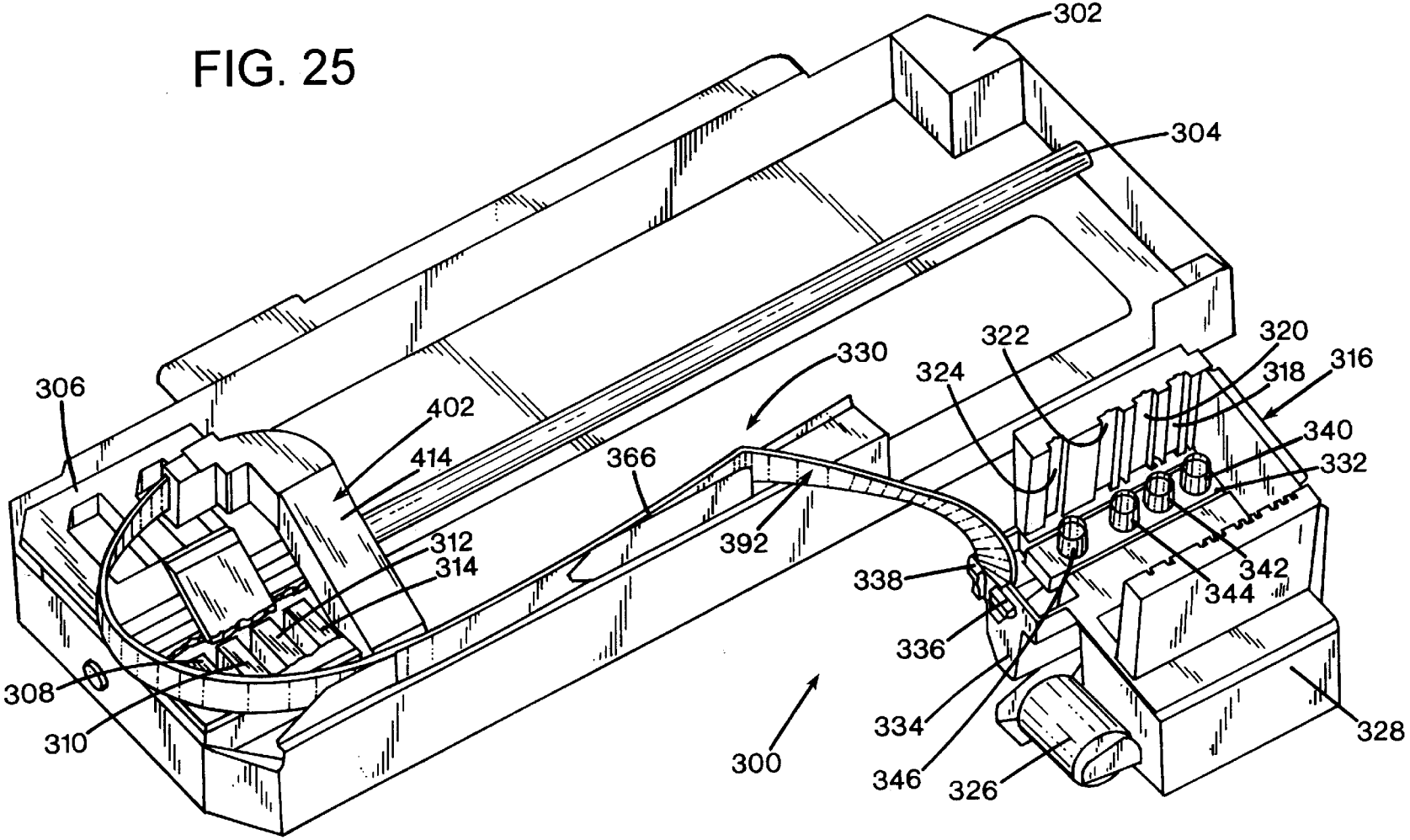
FIG. 25 is a perspective view of an embodiment of a printing composition delivery system in accordance with the present invention.
Figure 26:
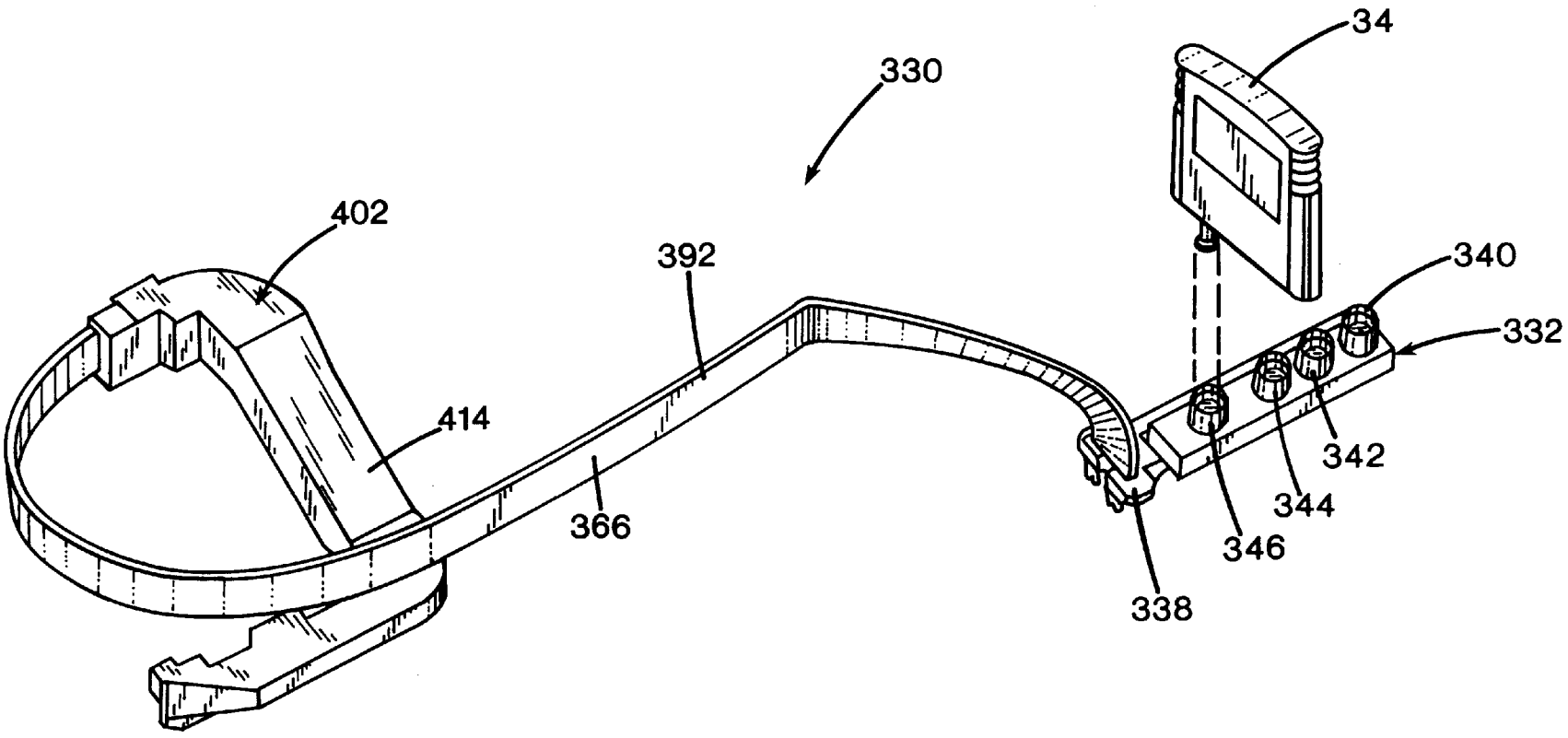
FIG. 26 is a perspective view of an embodiment of a module in accordance with the present invention for a printing composition delivery system.

A perspective view of an embodiment of a printing composition delivery system 300 for use in a printing device, such as an ink-jet printer, is shown in FIG. 25. Also shown is a portion of the printing device including a frame 302, a slide rod 304 attached to frame 302, and a scanning carriage 306, similar to carriage 16" shown in FIGS. 23 and 24. Carriage 306 is coupled to rod 304 so as to be drivable along rod 304 by a motor (not shown). The printing device also includes one or more printing members that print an image, here shown in FIG. 25 as print cartridges 308, 310, 312, and 314, which are similar or identical to print cartridges 18 shown and described above.

Printing composition delivery system 300 includes a printing composition supply station 316 having a printing composition supply (not shown in FIG. 25) which may include replaceable ink supply cartridges, such as cartridges 31, 32, 33 and 34 described above, which are removably disposable in slots 318, 320, 322, and 324 of printing composition supply station 316. Printing composition supply station 316 additionally includes a pump motor 326 for supplying pressure to pump printing composition from the printing composition supply to the one or more printing members, such as print cartridges 308, 310, 312, and 314. Printing composition supply station 316 additionally includes an electronic housing 328 that encloses circuitry for controlling operation of components of printing composition supply station 316 such as pump motor 326.

A module 330 in accordance with the present invention is shown in FIG. 25 as well as FIGS. 26–30. Module 330 is designed as a separable unit from printing composition delivery system 300. Module 330 includes a printing composition supply station connector 332 that is releasably attached to a member 334 of printing composition supply station 316. As shown in FIG. 25, this releasable attachment can be accomplished, for example, by providing a slot 336 in which a flat plate 338 of connector 332 is disposed. Printing composition supply station connector includes a plurality of couplers 340, 342, 344 and 346 each of which is fluidly connectable to the printing composition supply, as shown for example, in FIG. 26 with replaceable ink supply cartridge 34 and coupler 346.

Figure 27:
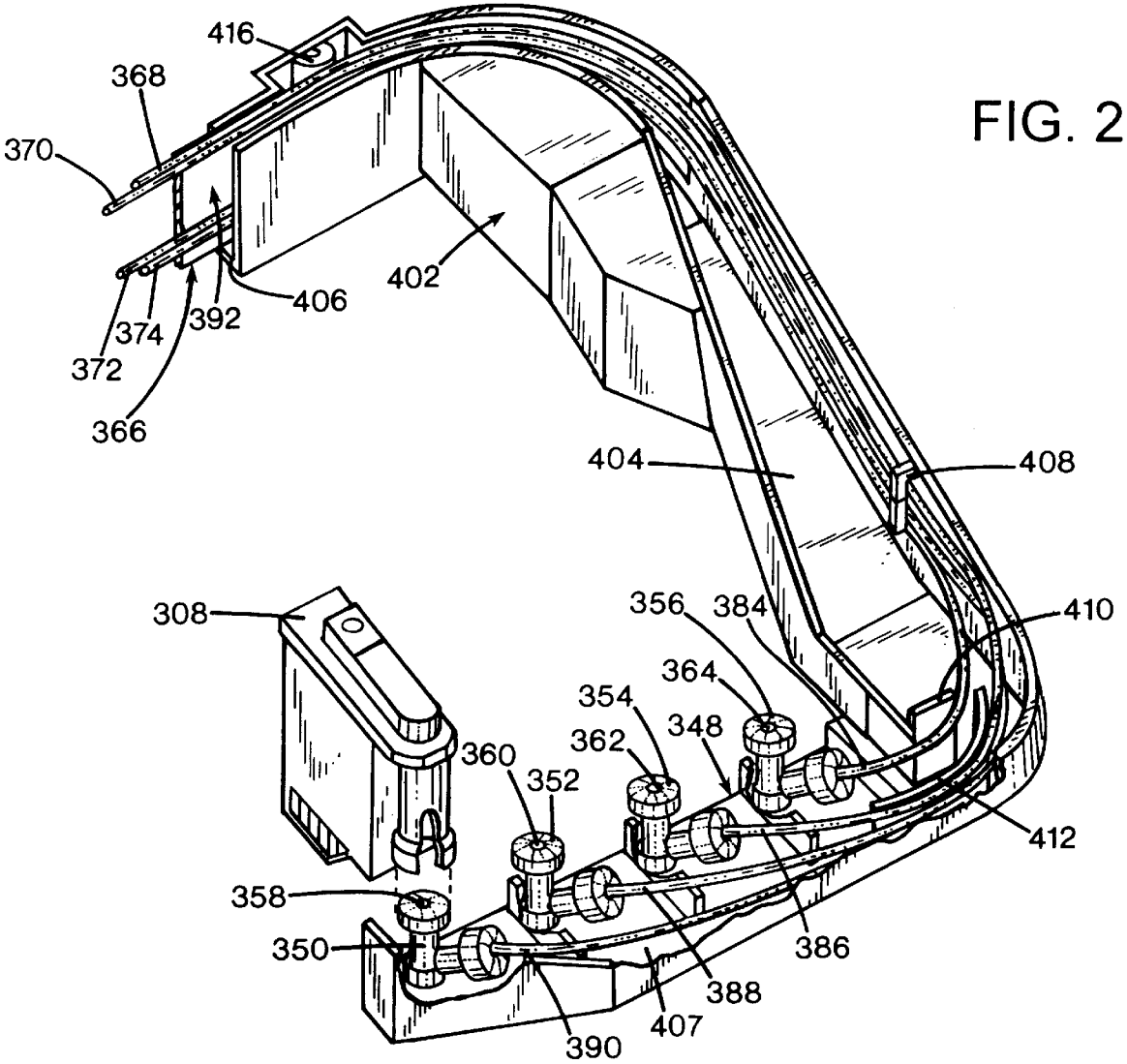
FIG. 27 is a perspective, partially broken-away view of a printing member connector, flexible conduit, flexible conduit carrier, and housing of the module of FIG. 26.

Module 330 also includes a printing member connector 348, shown in FIG. 27, having a plurality of couplers 350, 352, 354, and 356 fluidly connectable to printing members such as cartridges 308, 310, 312 and 314. Couplers 350, 352, 354, and 356 include septum elbows that each include respective openings 358, 360, 362, and 364 in which needles (not shown in FIG. 27) of respective print cartridges 308, 310, 312 and 314 may be disposed for fluid connection therewith, as shown and described above, for example, in connection with FIG. 9.

Figure 28:
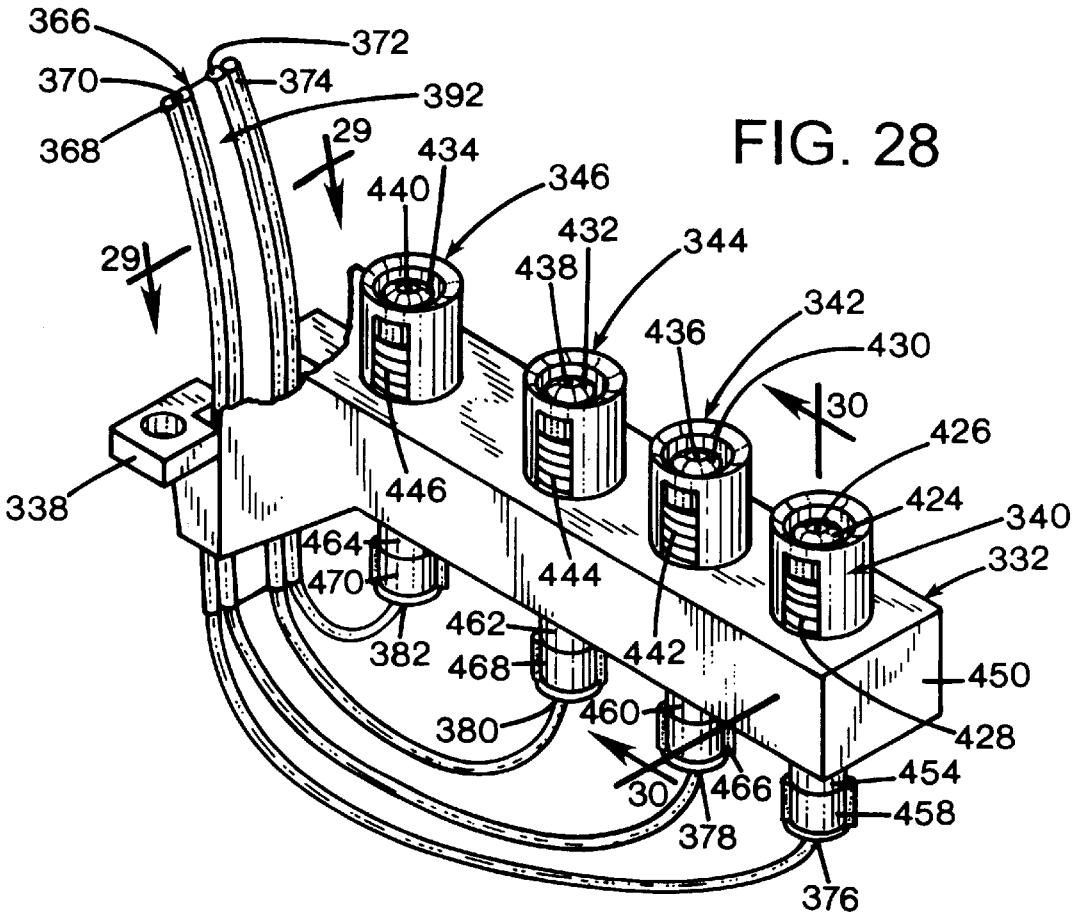
FIG. 28 is a perspective view of a printing composition supply station connector, flexible conduit, and flexible conduit carrier of the module of FIG. 26.
Figure 29:
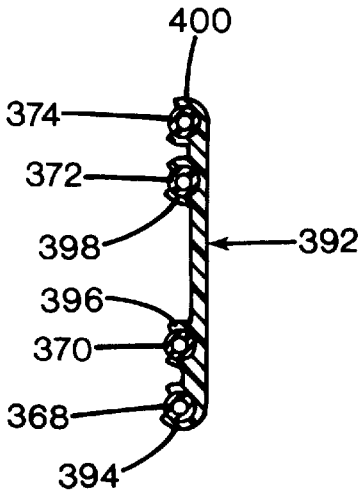
FIG. 29 is a view of the flexible conduit and flexible conduit carrier taken along line 29—29 of FIG. 28.

Module 330 additionally includes a flexible conduit 366 for supplying printing composition from the printing composition supply of printing composition supply station 316 to the one or more printing members, such as print cartridges 308, 310, 312, and 314. As shown in FIGS. 27–29, flexible conduit 366 may include a plurality of flexible tubes 368, 370, 372 and 374. Tubes 368, 370, 372, and 374 of flexible conduit 366 each include respective first-ends 376, 378, 380 and 382 fluidly connected to respective couplers 340, 342, 344, and 346 of printing composition supply station connector 332, as shown in FIG. 28. Tubes 368, 370, 372, and 374 of flexible conduit 366 each also include respective second-ends 390, 388, 386, and 384 fluidly connected to respective couplers 350, 352, 354, and 356 of printing member connector 348, as shown in FIG. 27. Tubes 368, 370, 372, and 374 of flexible conduit 366 may be made from polychlorotrifluoroethylene, also known as PCTFE or ACLON®.

Module 330 may additionally include a flexible tube carrier 392 having tube receiving channels 394, 396, 398 and 400 in which respective tubes 368, 370, 372, and 374 are disposed, as shown in FIG. 29. Tube carrier 392 may be made from polyolefin. Alternatively, although not shown, tubes 368, 370, 372, and 374 of conduit 366 may be fabricated as an integral extrusion such that tubes 368, 370, 372, and 374 are joined together by portions of the extrusion, as discussed above in connection with FIG. 15.

Module 330 may additionally include a housing 402 covering a portion of couplers 350, 352, 354 and 356, and enclosing a portion of flexible conduit 366. Housing 402 provides mechanical support for these components of module 330 during installation and removal of module 330, as well as during fluid connection of the printing members 308, 310, 312, and 314 to respective couplers 350, 352, 354, and 356. As shown in FIG, 27, housing 402 and printing member connector 348 may be integral. In other embodiments of the present invention, however, housing 402 and printing member connector 348 may be nonintegral. Housing 402 may be made from plastic.

Housing 402 and print member connector 348 are releasably attached to carriage 306 of the printing device by placing housing 402 and print member connector 348 on carriage 306. A fastener may additionally be disposed through carriage 306 and print member connector 348. A fastener may also be disposed through carriage and housing 402. Print member connector 348 is further releasably attached to carriage 306 via print cartridges 308, 310, 312 and 314 which are respectively attached to septum elbows 350, 352, 354, and 356, and disposed in slots of carriage 306 like those shown in carriage 16" in FIG. 23.

Housing 402 includes a conduit routing member 404 which is configured to guide tubes 368, 370, 372 and 374 of flexible conduit 366 down from a portion 406 of housing 402 along an axis of movement of carriage 306 to a portion 407 of housing 402 below portion 406. The change in plane defined by housing 402 facilitates a narrow form factor for applications which are sensitive to printer depth, as discussed above. As also discussed above, the change in plane also allows placing of the printing composition supply above the carriage which helps throughput by providing extra pressurization on the printing composition delivery system. In other embodiments of the present invention, conduit routing member 404 of housing 402 may guide tubes 368, 370, 372, and 374 of flexible conduit 366 down another side of carriage 306 other than that shown in FIG. 25, including the side opposite that shown in FIG. 25.

A clamp 408 and partitions 410 and 412 of tube routing member 404 help respectively secure and guide tubes 368, 370, 372 and 374. Clamp 408, partitions 410 and 412, and the shape of tube routing member 404 also help tubes 368, 370, 372, and 374 of flexible conduit 366 assume the curvature shown in FIG. 27 through stress relaxation rather than heat forming.

Housing 402 also includes a removable cover 414 which may be releasably secured by one or more fasteners (not shown) which are received in bosses such as boss 416 shown in FIG. 27. In other embodiments of the present invention, cover 414 may be integral with housing 402.

Figure 30:
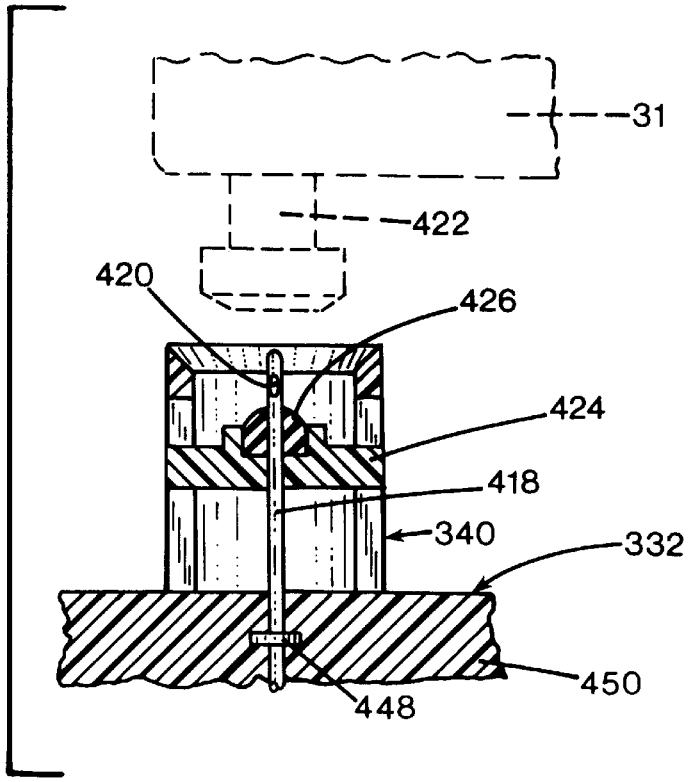
FIG. 30 is a view of a portion of a coupler of the printing composition supply station connector taken along line 30—30 of FIG. 28.

As discussed above, couplers 340, 342, 344, and 346 of printing composition supply station connector 332 are fluidly connectable to a printing composition supply such as replaceable ink supply cartridges 31, 32, 33 and 34. An example of such a connection is shown in FIG. 30 between coupler 340 and replaceable ink supply cartridge 31. Coupler 340 includes a hollow needle 418 having an opening 420 through printing composition is delivered. Needle 418 is received in septum 422 of cartridge 31. Printing composition from cartridge 31 flows through opening 420 into needle 418. The connection between needle 418 and 422 is sealed by biased plunger 424 and an elastomeric seal 426. Plunger 424 and seal 426 are biased against septum 422 by a biasing member, such as spring 428 shown in FIG. 28, to seal the connection between needle 418 and septum 422. Couplers 342, 344, and 346 include respective plungers 430, 432, and 434, as well as respective seals 436, 438, and 440. Plungers 430, 432, and 434, and seals 436, 438, and 440 are each biased by a biasing member, such as respective springs 442, 444, and 446. As can be seen in FIG. 30, hollow needle 418 includes a flange 448 secured in body 450 of connector 332. Needles (not shown) of couplers 342, 344, and 346 also include flanges (also not shown) to secure them to body 450 as well.

Figure 31:
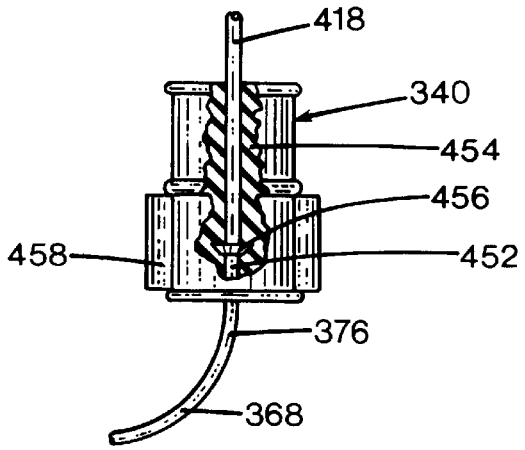
FIG. 31 is a view of another portion of the coupler of the printing composition supply station connector shown in FIG. 30.

As discussed above, a first-end 376 of tube 368 is connected to coupler 340. FIG. 31 shows first end 376 of tube 368 connected to an end 452 of hollow needle 418. End 452 is secured in an elastomeric material 454 via a flange 456 as shown in FIG. 31. Elastomeric material 454 is compressed around the flange 456 of needle 418 via a clamp 458. Couplers 342, 344, and 346 also include respective elastomeric material 460, 462, and 464 secured around flanges (not shown) of needles (also not shown) via respective clamps 466, 468 and 470 to fluidly couple to first ends 378, 380 and 382 of respective tubes 370, 372 and 374.

Figure 32:
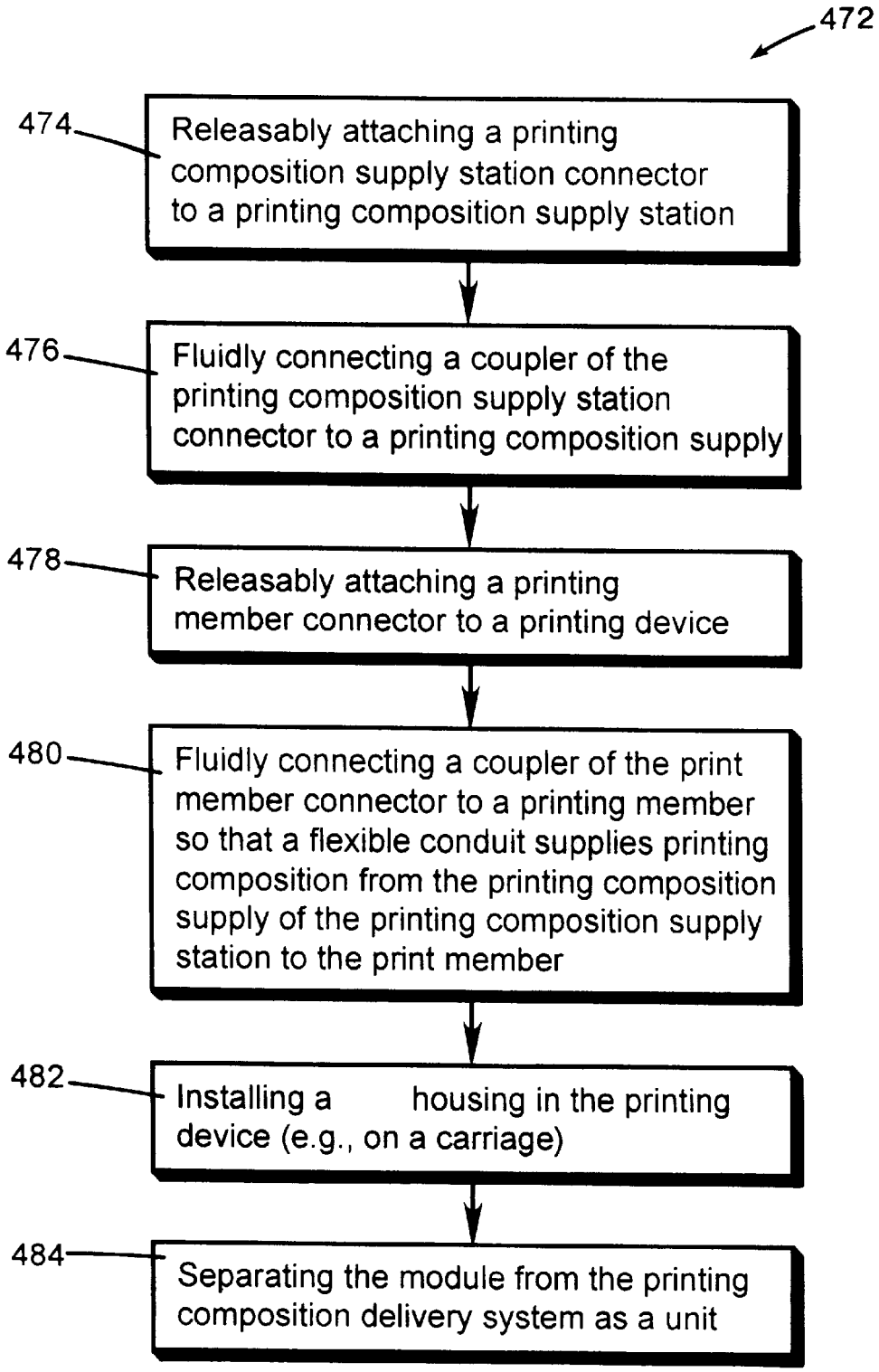
FIG. 32 is a flowchart of a method in accordance with the present invention.

As discussed above, the present invention also relates to a method of installing and removing a module for a printing composition delivery system. A flowchart of a method 472 in accordance with the present invention is shown in FIG. 32. As shown in FIG. 32, method 472 includes the step 474 of releasably attaching a printing composition supply station connector, such as connector 332, to a printing composition supply station, such as station 316, and the step 476 of fluidly connecting a coupler of the printing composition supply station connector, such as coupler 346, to a printing composition supply, such as replaceable ink supply cartridge 34. Method 472 additionally includes the step 478 of releasably attaching a printing member connector to the printing device, such as print member connector 348, and the step 480 of fluidly connecting the coupler of the printing member connector, such as coupler 350, to the printing member, such as print cartridge 308, so that a flexible conduit, such as conduit 366, supplies printing composition from the printing composition supply of the printing composition supply station to the printing member.

For modules that include a housing, such as housing 402, method 472 may additionally include the step 482 of installing the housing in the printing device. For printing devices that include a carriage, such as carriage 306, the housing may installed on the carriage of the printing device, as indicated by step 482. Method 472 may further include the step 484 of separating the module from the printing composition delivery system as a unit. Such separation can be achieved by detaching printing composition supply station connector from the printing composition supply station, detaching the printing member connector from the printing device, and then removing the module. The one or more printing members and the printing composition supply may be removed from the couplers of the printing compassion supply station connector and the printing member connector before or after the module is removed.

The present invention provides advantages over the currently known art. As discussed above, the ability to easily separate the wetted components of the printing composition delivery system from the unwetted ones is desirable for several reasons. For example, wetted components of the printing composition delivery system must be leak-tight. Inspection, testing, and servicing of leak-tight components of the printing composition delivery system are simplified if these components are a separable unit from the printing composition delivery system. Additionally, wetted components in actual contact with the printing composition are more likely to be subject to corrosive action of printing composition solvents and may be rendered inoperable due to clogging of dried printing composition under certain long-term environmental conditions. The unwetted components of the printing composition delivery system may have longer life due to a lack of contact with the printing composition. The ability to remove a damaged module wetted by the printing composition and replace it with a new one prevents the need to replace the entire printing composition delivery system, including the undamaged portion or, alternatively, the entire printing device. This ability to replace only a module of the printing composition delivery system thus saves costs. It also increases expected reliability of repair because it eliminates the need for electrical connections to be made to replaced parts which can be fragile and subject to mechanical damage from things such as improper insertion or contamination from debris.

A further advantage of a replaceable module is that it enables use of different incompatible printing compositions in the same printing device by switching components of the printing composition delivery system which are wetted by the printing composition. Without such replacement, incompatible printing compositions could mix in the printing composition delivery system and cause failure or degraded performance of the printing device.

Although the invention has been described and illustrated in detail, it is to be clearly understood that the same is intended by way of illustration and example only, and is not to be taken by way of limitation. For example, although the printing member connector and the printing composition supply station connector have been illustrated in the drawings as each having a plurality of couplers, other embodiments of these components of the present invention may include only a single coupler. As another example, the present invention may find application in ink jet printers other than those described and/or shown above. As a further example, the present invention may find application in printing devices other than ink-jet printers, such as facsimile machines or plotters. The spirit and scope of the invention are to be limited only by the terms of the following claims.

What is claimed is:

1. A module for a printing composition delivery system of a printing device, the printing composition delivery system including a printing composition supply station attached to the printing device and having a printing composition supply, the printing device including a printing member, the module comprising:

a printing composition supply station connector releasably attached to the printing composition supply station, the printing compositions supply station connector having a coupler which is fluidly connectable to the printing composition supply;

a printing member connector releasably attached to the printing device, the printing member connector having a coupler which is fluidly connectable to the printing member;

a flexible conduit separate from the printing composition supply and the printing member for supplying printing composition from the printing composition supply of the printing composition supply station to the printing member, the flexible conduit including a first end terminating at and fluidly connected to the coupler of the printing composition supply station connector and a second end terminating at and fluidly connected to the coupler of the printing member connector; and a housing covering a portion of the coupler of the printing member connector and enclosing a portion of the flexible conduit adjacent the printing member connector;

wherein the printing composition supply station connector, the printing member connector, the housing, and the flexible conduit are a separable unit from the printing composition delivery system, the printing composition supply, and the printing member.

2. The module of claim 1, wherein the housing and the printing member connector are integral.

3. The module of claim 1, wherein the housing includes a conduit routing member.

4. The module of claim 3, the printing device including a carriage that is driven along an axis, wherein the conduit routing member is configured to include a first portion along the carriage axis and a second portion below the first portion.

5. The module of claim 1, wherein the housing includes a removable cover over the conduit routing member.

6. The module of claim 1, further comprising a flexible conduit carrier in which the conduit is disposed, the flexible conduit carrier holding the conduit in an aligned manner, wherein the printing composition supply station connector, the printing member connector, the flexible conduit, the flexible conduit carrier, and the housing are a separable unit from the printing composition delivery system.

7. The module of claim 1, the printing composition supply including a plurality of printing composition supply cartridges and the printing device having a plurality of printing members including printing cartridges, wherein the printing composition supply connector includes a plurality of couplers each of which is fluidly connectable to one of the printing composition supply cartridges;

wherein the printing member connector includes a plurality of couplers each of which is fluidly connectable to one of the print cartridges; and wherein the flexible conduit includes a plurality of flexible tubes for supplying printing composition from the printing composition supply cartridges to the print cartridges, the flexible tubes each including a first end fluidly connected to one of the couplers of the printing composition supply station connector and a second end fluidly connected to one of the couplers of the printing member connector.

8. The module of claim 1, wherein the coupler of the printing member connector includes a septum elbow.

9. The module of claim 1, wherein the coupler of the printing composition supply station connector includes a hollow needle coupled to the printing composition supply for receiving printing composition from the printing composition supply, and a biased plunger and seal for sealing a connection between the needle and the printing composition supply.

10. A printing device comprising the module as recited in claim 1.

11. An ink-jet printing device comprising the module as recited in claim 1.

12. A method for use in a printing device, the printing device including a printing composition delivery system, a printing member, and a module, the printing composition delivery system including a printing composition supply station having a printing composition supply and the module including a printing composition supply station connector having a coupler, a printing member connector having a coupler, a flexible conduit separate from the printing composition supply and the printing member, the flexible conduit having a first end terminating at and fluidly connected to the coupler of the printing composition supply station connector and a second end terminating at and fluidly connected to the coupler of the printing member connector, and a housing covering a portion of the coupler of the printing member connector and enclosing a portion of the flexible conduit adjacent the printing member connector, the method comprising the steps of:

releasably attaching the printing composition supply station connector to the printing composition supply station;

fluidly connecting the coupler of the printing composition supply station connector to the printing composition supply;

releasably attaching the printing member connector to the printing device;

fluidly connecting the coupler of the printing member connector to the printing member so that the flexible conduit supplies printing composition from the printing composition supply of the printing composition supply station to the printing member; and installing the housing in the printing device.

13. The method of claim 12, wherein the printing device includes a carriage, and further comprising the step of installing the housing on the carriage of the printing device.

14. The method of claim 12, further comprising the step of separating the module from the printing composition delivery system as a unit.

* * * * *